US010285511B1

(12) United States Patent
Pozzi et al.

(10) Patent No.: US 10,285,511 B1
(45) Date of Patent: May 14, 2019

(54) DISPENSING TRAY, DISPLAY SYSTEM AND METHOD

(71) Applicant: Franklin Display Group, Inc., Belvidere, IL (US)

(72) Inventors: Matthew Thomas Pozzi, Rockford, IL (US); David Paul Kelley, Belvidere, IL (US); Eric Alan McCoy, Woodstock, IL (US); George Francis Mutert, Belvidere, IL (US); Scott Edward Fowler, Belvidere, IL (US)

(73) Assignee: Franklin Display Group, Inc., Belvidere, IL (US)

( * ) Notice: Subject to any disclaimer, the term of this patent is extended or adjusted under 35 U.S.C. 154(b) by 0 days.

(21) Appl. No.: 15/801,921

(22) Filed: Nov. 2, 2017

(51) Int. Cl.

| | |
|---|---|
| ***A47F 1/12*** | (2006.01) |
| ***A47F 5/00*** | (2006.01) |
| ***A47F 7/00*** | (2006.01) |
| ***A47F 7/28*** | (2006.01) |
| ***G09F 7/10*** | (2006.01) |
| ***A47B 57/58*** | (2006.01) |
| ***A47B 65/00*** | (2006.01) |

(Continued)

(52) U.S. Cl.
CPC ..... *A47F 1/126* (2013.01); *A47B 57/58* (2013.01); *A47B 65/10* (2014.12); *A47B 96/04* (2013.01); *A47F 5/005* (2013.01); *A47F 7/0007* (2013.01); *A47F 7/28* (2013.01); *G09F 7/10* (2013.01); *G09F 23/06* (2013.01)

(58) Field of Classification Search
CPC ..... A47F 1/126; A47F 7/0007; A47F 7/28; A47F 1/04; A47F 1/10; A47F 1/12; A47F 1/125; A47F 2005/165; A47F 3/02; A47F 3/06; A47F 3/063; A47F 5/005; G09F 7/10; G09F 23/06; B65G 1/07; B65G 1/08; A47B 73/00; A47B 57/58; A47B 57/583; A47B 57/585; A47B 57/586; A47B 57/588; A47B 65/10; A47B 65/00; A47B 65/15; A47B 96/04; A47B 5/132; A47B 7/144
USPC ..... 211/175, 59.3, 184, 59.2, 74, 43, 50, 51; 312/35, 61, 71, 72, 73, 42; 108/60, 61
See application file for complete search history.

(56) References Cited

U.S. PATENT DOCUMENTS 793,914 A * 7/1905 Shumaker ..... A47F 7/148 211/50
1,537,167 A * 5/1925 Barnhill ..... B42F 17/02 211/51

(Continued)

*Primary Examiner* — Jennifer E. Novosad
(74) *Attorney, Agent, or Firm* — Hinshaw & Culbertson LLP

(57) ABSTRACT

Item trays include an optional product advancing member, a tray-like lower support, and a pair of side supports, at least one of them being deflectable and inwardly biased, that accommodate merchandise queues of various item widths by a self-adjusting clamping action. A biasing member supplying the clamping force of the side support(s) may be preloaded. Display systems include a plurality of such trays supported by a rear mounting wall providing a plurality of tray mounting locations to provide modular configurability of tray positions, thus accommodating different products on separate trays. The display systems may be built around a wire frame and include display supporting members, such as suitable slot members, for receiving and retaining a full length side graphic panel. The item trays may be used in a merchandise dispensing method for items of like dimensions.

20 Claims, 25 Drawing Sheets

(51) Int. Cl.
*A47B 96/04* (2006.01)
*G09F 23/06* (2006.01)

(56) References Cited

U.S. PATENT DOCUMENTS 1,674,359 A * 6/1928 Frey ..... B42F 17/02 211/43
2,351,571 A * 6/1944 Burlin ..... A47F 7/148 211/50
2,407,119 A * 9/1946 Weston ..... B42F 17/02 211/50
2,433,788 A * 12/1947 Schade ..... B42F 17/02 16/444
2,452,687 A * 11/1948 Schade ..... B42F 17/02 211/51
2,474,763 A * 6/1949 Thomas ..... G09F 1/14 211/42
2,603,357 A * 7/1952 Zakos ..... G09F 1/14 211/43
2,624,343 A * 1/1953 Welk ..... B42F 17/02 211/51
2,637,324 A * 5/1953 Segal ..... B42F 17/02 211/51
2,642,861 A * 6/1953 Tvedt ..... B42F 17/02 211/51
2,910,069 A * 10/1959 Sewell ..... B42F 17/02 211/51
2,954,129 A 9/1960 Gordon
3,182,806 A * 5/1965 Lambert ..... A47B 65/00 211/120
3,241,683 A * 3/1966 Blodee ..... A47B 57/585 211/184
3,339,746 A * 9/1967 McCabe ..... A47B 57/585 211/184
3,487,945 A * 1/1970 Barham ..... A47B 65/00 211/184
3,747,775 A * 7/1973 Merola ..... A47B 65/00 211/43
3,800,958 A * 4/1974 Dorn ..... A47B 65/00 211/181.1
3,844,415 A * 10/1974 Heimann ..... A47B 65/00 211/43
4,023,682 A * 5/1977 Niece ..... A47B 57/581 108/27
4,318,485 A 3/1982 Clement
4,648,515 A * 3/1987 Merritt ..... B42F 13/40 108/61
5,221,011 A * 6/1993 Coto ..... A47F 7/14 211/43
5,415,297 A * 5/1995 Klein ..... A47B 81/068 108/61
5,505,315 A * 4/1996 Carroll ..... A47F 1/125 211/51
D369,528 S * 5/1996 Brooks ..... D7/631
5,562,217 A * 10/1996 Salveson ..... A47F 1/126 211/175
5,727,696 A * 3/1998 Valiulis ..... A47F 1/126 211/51
5,772,046 A * 6/1998 Tercher ..... A47F 7/0028 211/12
5,816,418 A * 10/1998 Hsu ..... A47F 7/0042 211/120
5,988,407 A * 11/1999 Battaglia ..... A47F 1/126 211/51
6,375,015 B1 * 4/2002 Wingate ..... A47F 1/126 211/175
6,405,880 B1 * 6/2002 Webb ..... A47F 1/12 108/107
6,464,089 B1 10/2002 Rankin, VI
6,698,599 B1 * 3/2004 Hannecke ..... A47F 7/146 206/449
6,820,753 B2 * 11/2004 Kurtz ..... A47K 10/20 211/49.1
D507,156 S * 7/2005 Heiberg ..... D7/631
7,097,052 B2 * 8/2006 Lau ..... G11B 33/0466 211/184
7,584,861 B2 * 9/2009 Werner ..... A47B 45/00 211/184
7,950,537 B1 * 5/2011 Goodman ..... A47B 57/581 211/184
8,386,075 B2 2/2013 Lockwood et al.
9,624,027 B2 * 4/2017 DeGraaf ..... B65D 83/0817
2004/0256341 A1 * 12/2004 Donnell ..... A47F 1/12 211/187
2005/0167375 A1 8/2005 Pagano
2007/0068884 A1 * 3/2007 DiPietro ..... A47G 21/16 211/50
2010/0072150 A1 * 3/2010 Takashima ..... A47F 5/0025 211/59.3
2011/0204009 A1 * 8/2011 Karan ..... A47F 1/12 211/59.2
2012/0193311 A1 * 8/2012 Benasillo ..... A47F 5/0018 211/59.2
2013/0193156 A1 8/2013 Kaleta et al.
2014/0299559 A1 * 10/2014 Bird ..... A47F 1/04 211/59.2
2014/0319086 A1 * 10/2014 Sosso ..... A47F 1/126 29/428
2015/0108074 A1 * 4/2015 Pichel ..... A47F 5/005 211/59.3
2017/0164762 A1 * 6/2017 Bryson ..... A47F 1/126
2017/0196355 A1 * 7/2017 Hardy ..... A47B 57/588
2017/0360220 A1 * 12/2017 Hester-Redmond .... A47F 1/125
2018/0103774 A1 * 4/2018 Chenoweth ..... F21V 21/08

* cited by examiner

DISPENSING TRAY, DISPLAY SYSTEM AND METHOD

FIELD OF THE INVENTION

The present invention relates to merchandise displays, and more particularly to dispensing merchandise displays with a product feed mechanism.

BACKGROUND

Various display locations in retail stores, such as store aisle end caps, checkout counters, and other prominent locations, are prime locations for drawing consumers' attention to "impulse buy" items, such as, in a grocery store setting, certain condiments, snacks, beverages, and the like. The items may be loaded in dispensing trays that can advance the items as the items are removed. However, the items can vary over the course of a year due to the change of seasons or the approach of different holidays and the containers for the items can vary significantly. It is therefore necessary to change the dispensing tray to match the item to be displayed and dispensed.

A need therefore exists for a dispensing tray that can accommodate product queues of various widths.

To better draw the attention of shoppers, displays known as "power wings" (also referred to herein as "power wing displays") are therefore made for mounting to end caps for displaying such items. Power wing displays may include means for prominently presenting advertising images and/or advancing a queue of merchandise items forward to position a front item in a dispensing/removal position from which the front item is easily reached and removed. Wire frame structures with standard dimensions and mounts are frequently selected for this purpose, as they are convenient to manufacture, install, and reposition, while supporting a significant amount of weight for their size.

Some companies manufacture and/or merchandise "impulse buy" products of multiple types. For these companies, it is desirable to display a selection of several of their products in a unified display structure, but products that they wish to display together may be packaged in bottles, jars, cans, boxes, tubs, or other containers of various different shapes and sizes. Existing queue-feed type power wing displays typically have a uniform shelf or tray width. Product queues of wider widths will not fit on their shelves or trays, and product queues of narrower widths may bunch together, tip over, slip below a rail and fall off the tray, or otherwise become misaligned in a way that makes the queue visually unappealing and/or could result in damaged products or product containers. In addition, presenting product queues of various heights on different trays or shelves of a standardized power wing display may result in disparities in overhead space, which may be visually unappealing and/or negatively impact capacity, in a location where space comes at a high premium.

Consequently, a need exists for a multi-level dispensing display frame that can simultaneously accommodate product queues of different widths at separate levels. In addition, a need exists for a configurable multi-level dispensing display frame that can simultaneously accommodate product queues of different heights on separate trays, while limiting the amount of unused overhead space above product queues of smaller heights.

SUMMARY OF THE INVENTION

Dispensing tray, display system and method according to the invention are summarized in this section. In accordance with one aspect of the invention, an item dispensing tray for items of like dimensions is provided. The tray comprises a lower support, an optional item advancing member, an item stop, elongate first and second side supports, and a side support biasing component.

The lower support is generally horizontal and elongate for supporting a queue of items. It has first and second sides, a rear end and a front end displaced horizontally from the rear end in a horizontal forward feed direction. In other words, the "horizontal forward feed direction" will be understood to be the horizontal component of a direction extending along the lower support, which may optionally be inclined from a horizontal plane to provide a gravity feed, from its rear end to its front end, although advantages provided by a gravity feed are likely outweighed by disadvantages of an inclined lower support, as discussed further below.

"Generally horizontal" will be understood to mean substantially more horizontal than vertical. That is, while a "generally horizontal" base member may be inclined somewhat, such as to provide a gravity feed, it is inclined from a horizontal plane by less than 45°, preferably less than about 22° and most preferably by about 12° or less. Desirably, the lower support supports items of merchandise thereon at an angle to the line of sight of a consumer that displays prominently and attractively the branding and/or characteristic packaging shape of the items. In one preferred embodiment, the angle of support is 0° or nearly 0° with respect to a horizontal plane. While a gravity feed may in some embodiments assist or substitute for a spring-biased item pusher mechanism, a steep downward incline of a tray that is generally at or below consumer eye level would undesirably tilt the supported items away from a shopper's line of sight. In addition, the steeper the angle of a gravity feed, the greater will be the tendency of a supported item to tip over forward on the tray, such as when encountering uneven or excessive friction or an unexpected obstruction on the lower support.

The optional item advancing member is configured to transmit an advancing force to the queue of items in the horizontal forward feed direction. The item advancing member can be a conveyor belt, an elastic band around the items or other suitable device. Preferably, the item advancing member is a spring-biased pusher member. The pusher member is disposed behind a queue of items on the tray, transmitting a normal contact pusher force, supplied by a spring force, to a rear item of the queue to push the queue forward. A line of action of the spring force, and likewise of the pusher force, is perhaps most efficiently and conveniently aligned parallel to the top surface of the lower support, although lines of action with substantial components parallel to the top surface of the lower support would suffice. As used herein, the "advancing force" supplied by the pusher member is the component of the pusher force in the horizontal forward feed direction, that is, the entire pusher force if its line of action is horizontal, or a forward feed direction component of the pusher force if its line of action is angled with respect to the forward feed direction. The advancing force advantageously decreases as the pusher approaches the forward dispensing position, corresponding to items in the queue being shopped down, reducing the number, and thus the mass, of items being pushed forward.

The item stop is disposed near the front end of the lower support and is configured to obstruct movement of a front item of the queue of items in the horizontal forward feed direction, when the front item is supported on the lower support at a dispensing position proximate to the front end of the lower support. The item stop may, for example, comprise an upturned "lip" feature at the front end of the lower support, as in an embodiment described and illustrated herein. Preferably, the item stop is configured to contact the front item at a position relative to the center of gravity of the front item suited to prevent deflecting the item transversely in an undesired direction. For example, it may be desirable to position the item stop to transmit a stop force to the front item having a line of action extending near or through a center of gravity of the front item, and/or to provide two or more item stops to transmit stop forces along different lines of action relative to the center of gravity of the front item, so as to enhance stability. For example, a lower item stop positioned below the mass center of the front item may comprise an upturned lip at the front of the lower support, while an upper item stop working in conjunction with the lower item stop is positioned above the mass center of the front item, to at least substantially prevent tipping of the front item below the upper item stop or over the lower item stop. More generally, an item stop may comprise any suitable mechanical obstruction or restraint of forward movement of the front item.

The elongate first side support extends along and above the first side of the lower support. The elongate second side support extends along and above the lower support and is spaced laterally from the first side support. The second side support may be spaced substantially parallel to the first side. The elongate first and second side supports are referred to in the illustrated embodiments as "fences" and are generally shaped like slender walls, having broad, closed inward and outward facing surfaces. However, in many cases only a top item contact section of the fences is configured to contact and supply a clamping force to queued items. Thus, in other embodiments not shown, the first and second side supports may instead comprise a wire loop or similar peripheral member delimiting an open area, where the top segment of the peripheral member performs the function of the item contact sections of the disclosed fences. The tray further comprises elongate first and second side supports connected to the lower support. Advantageously, they may be removably connected so as to be relatively interchangeable, such as by mating rib and slot features. Alternatively, they may be permanently bonded to the lower support, or integrally formed with the lower support as a unitary feed channel member.

The lower support and the first and second side supports together define an item queue feed channel extending in a longitudinal direction from the rear end of the lower support to the front end of the lower support. The first and second side supports are configured to retain the queue of items supported on the lower support between the first and second side supports. A respective contact section of each of the first and second side supports is configured to contact a respective first and second side of items in the queue of items. At least one of the side supports is deflectable so that its contact section is movable towards or away from the contact section of the other side support. Preferably, the contact section of the deflectable side support is movable towards and away from the other side support. The deflection path may be horizontal, slightly inclined, or, as in the illustrated embodiment, arcuate corresponding to the pivotal deflection of the side supports.

The side support biasing component is configured to bias the contact section of the at least one deflectable side support relative to the lower support in a clamping direction generally toward the contact section of the other side support. In other words, the clamping direction is a direction tending to reduce a horizontal item width clearance between the contact sections. The contact sections are configured to transmit a clamping force to the respective first and second sides of each item of the queue of items to resist lateral transverse movement of a queue of items supported on the lower support between the first and second side supports.

Both the first side support and the second side supports are preferably deflectable side supports.

The deflectable side support may be a unitary side support member comprising the movable contact section and the biasing component. In other words, the contact section and side support biasing component may be part of a single body integrally formed of a single material or multiple materials. Though not shown in the illustrated example, the side support biasing component may be comprised in a subsection of the unitary side support member, which may, for example, have a significantly thinner cross-section than the contact section to permit it to undergo localized elastic deformation (strains) and associated elastic stresses to produce a biasing effort (i.e., a force or torque) to bias the contact section.

Alternatively, the unitary side support member has a generally uniform transverse thickness, so that the elastic stresses and strains producing the biasing effort are distributed over a broad region of the side support member, possibly including some or all of the contact section.

In another embodiment, the movable contact section is comprised in a rigid contact member, and the side support biasing component is comprised in an elastically deformable biasing member connected to the contact member. A rigid contact section is believed to be advantageous in that it provides a consistently shaped contact area and facilitates a simple and predictable biasing response to deflection from a discrete spring component separate from the contact section. By "rigid", it will be understood that a material or member referred to tends not to appreciably deform under the stresses applied to the tray during normal use, namely, primarily those produced by the biasing force or torque applied by the side support biasing component and the resulting reaction forces produced by a preload stop associated with the side support biasing component, if any, and/or queued items under a clamping force.

The deflectable side support may include a generally rigid contact member and elastically deformable biasing member, permanently bonded together to form an integral body. In such embodiments, the contact member may be composed of a rigid material and the biasing member may be composed of an elastically deformable material different from the rigid material. "Permanently bonded" will be understood to mean joined in any suitable manner that prevents reversible (i.e., non-destructive) mechanical separation. The two members may, for example, be welded, overmolded, joined by a suitable adhesive, or, as in an illustrated embodiment, coextruded in such a manner as to form a permanent bond between materials that are different but compatible for coextrusion and bonding purposes. For example, the rigid material of the contact member may be rigid clear vinyl, and the elastically deformable material of the biasing member may be flexible polyvinyl chloride (PVC).

The integral body of the deflectable side support may further comprise a rigid connecting member configured to connect the side support to the lower support, the connecting member being composed of a rigid material different from the elastically deformable material of the biasing member. In some embodiments, the deflectable side support is formed by coextrusion of the rigid contact member, elastically deformable biasing member, and connecting member. In an illustrated embodiment, the connecting member is formed of rigid clear vinyl, like the contact member. However, the contact and connecting members may alternatively be formed of different materials, each compatible for coextrusion with the material of the biasing member.

Advantageously, a preload stop may be connected to the lower support or tray to facilitate preloading of the deflectable side support. The preload stop is configured to contact a portion of the deflectable side support when the movable contact section is at a minimum width clearance position, spaced from the other side support contact section by a minimum width clearance, to stop movement of the movable contact section in the clamping direction. This maintains the side support biasing component in a preloaded state in the absence of items in the item queue feed channel, so that, when the movable contact section is displaced from the minimum width clearance position in a direction opposite the clamping direction, by an item having a width clearance larger than the minimum width clearance, the movable contact section immediately responds by transmitting a preload clamping force to the item having the width clearance. In an extreme case, the preload stop is the other side support contact section, the minimum width clearance being zero. If both side supports are deflectable, each may thus effectively serve as the other's preload stop.

However, preferably, the minimum width clearance is non-zero. In the illustrated embodiments, this is facilitated by upwardly extending preload stops formed in the lower support, corresponding to each of two deflectable side supports. Also possible, though not shown, would be similarly shaped preload stops formed on deflectable side supports themselves, extending downwardly and/or inwardly to meet the lower support at a minimum clearance position. The preload stop may take any suitable shape, such as an elongate rib extending longitudinally along the lower support or side support.

According to another aspect of the invention, a dispensing display system is provided. The system includes a display frame including a rear mounting wall comprising at least one mounting feature at each of a plurality of spaced apart mounting locations; and a plurality of item dispensing trays substantially as summarized above, and further including mounting features mating with those of the rear mounting wall, connected to and supported by the rear mounting wall. The wall mounting features may, for example, be holes formed therein, and the tray mounting features may be hooks, teeth, or other male features (generically referred to as "hooks" herein) configured to mate with the hole. The holes and hooks in one illustrated embodiment have circular cross sections, and in another illustrated embodiment the holes have elongate rectangular cross sections, and are referred to more particularly as "slots". Many other alternative shapes may be suitable, and the terms "holes" and "hooks" will be understood to encompass holes of any suitable shape, and complementary male features.

A side subframe of the display frame connected to the rear mounting wall near a side edge thereof may include a lower graphic panel slot, a front end graphic panel slot, and a rear end graphic panel slot, the lower graphic panel slot being disposed below a lowermost dispensing tray when the lowermost dispensing tray is mounted at a lowermost one of the rear mounting wall mounting locations, and the front and rear end graphic panel slots being connected to the display frame proximate to front and rear ends of the display frame. In this manner, the graphic panel slots are configured to receive respective lower, front, and rear edges of a side subframe graphic panel slidingly received between the front and rear slots.

The mounting locations may be spaced apart vertically or horizontally. Advantageously, the mounting locations on the rear mounting wall may include at least one pair of mounting locations spaced apart by a fine adjustment vertical distance smaller than a height dimension of one of said dispensing trays. Preferably, all or a substantial portion of the mounting locations are spaced from adjacent mounting locations by such a fine adjustment vertical distance, to permit a desirable degree of flexibility to accommodate items of different heights on separate dispensing trays, without the items impinging on the next higher tray, extending above the top of the dispensing display system, or leaving an undesirable amount of unused overhead clearance between the tops of the supported items and the next higher tray or top of the display system.

According to another aspect of the invention, a merchandise dispensing method is provided, using a dispensing tray substantially as described above. The method comprises moving the movable contact section of the deflectable side support to an item width clearance distance from the contact section of the other side support greater than or equal to a width dimension of a plurality of merchandise items of like dimensions; and placing the plurality of merchandise items in the item queue feed channel to form a single-file queue of the items extending from the dispensing position towards the rear end of the tray. The side supports may be separated by hand or by contact with the inserted item. In the latter case, a flared or outwardly tapered upper end of one or both side supports may be provided to facilitate insertion of an item that is wider than a minimum clearance between their respective contact sections by simply pushing the item downward between the flared upper ends to cam the side supports apart from each other. In other instances, the inserted item itself may have a shape that facilitates this mode of insertion, such as a profile that tapers outwardly from its lower end. Alternatively, an item with a width profile that tapers inwardly toward its back surface, such as cylindrical items (cans, containers, and jars, for example), may in some cases be wedged between the front ends of the side supports by pushing the item in a rearward direction. In another mode of insertion not requiring the manual grasping of either side support, the item may be inserted in an oblique direction, either from above the side supports or from their front ends, using one side of the item to push one of the side supports aside until an opposite side of the item is clear of the other side support, moving the opposite side of the item into the feed channel, and then either manually reorienting the item to align with the channel, or passively allowing the biasing/clamping action of the side support members to reorient the fully inserted but obliquely oriented item.

DETAILED DESCRIPTION OF THE INVENTION

With reference to the accompanying drawings, dispensing display trays, systems and methods according to the invention are described in this section. Systems and methods of the invention are embodied, for example, in a power wing display 10, illustrated in and described with reference to FIGS. 1-7, a power wing display 10', illustrated in and described with reference to FIGS. 8A-14, and variations thereof. FIGS. 1-16 also illustrate embodiments of trays for use in the embodied systems and elsewhere. FIGS. 17-27 illustrate additional embodiments of trays and subassemblies for use in the embodied systems and elsewhere.

Figure 1A:
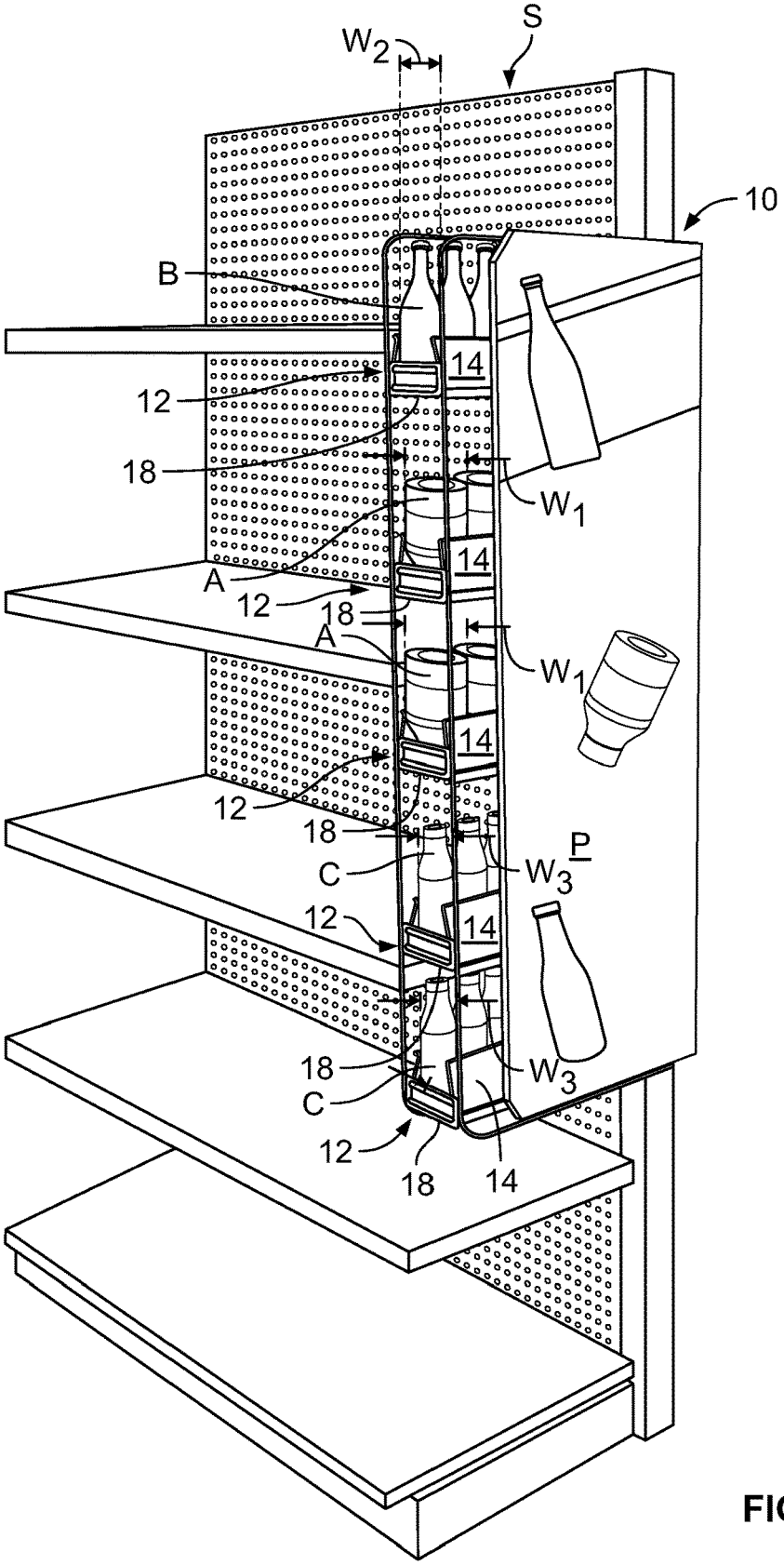
FIG. 1A is a perspective view of a display according to the invention, shown mounted to a store shelving end cap and supporting queues of merchandise items.

Turning to FIG. 1A, a power wing display 10 is mounted at store shelving structure end cap S, to illustrate an example of an advantageous mounting location. Display 10 supports a plurality of trays 12. Each tray 12 includes a pair of opposed, deflectable fences 14 and a lower support 15, together defining an item queue feed channel 17, as shown in more detail in FIGS. 6 and 7. Each fence 14 is biased inwardly toward the opposite fence 14, permitting self adjustment of a width clearance between fences 14 to the width dimension of a queue of products disposed therebetween. Thus, deflectable fences 14 are shown in a more deflected state when accommodating the illustrated containers A, having a wider retained dimension $W_1$ (shown in FIG. 7), than when accommodating the illustrated containers B and C, having narrower retained dimensions $W_2$ and $W_3$ (shown in FIGS. 1A and 6). As shown, fences 14 are pivotally biased, so that they tend to be inclined inwardly when in a more relaxed position accommodating narrower items and flex vertically when accommodating wider items. It is also within the scope of the invention, though not depicted, for fences 14 to be linearly biased instead of pivotally biased.

The self-adjusting width clearance provided by fences 14 serves to align the queue of products in a compact, visually appealing single-file formation, along a longitudinal axis extending from a rear end 16 to a front end 18 of the tray 12, while at the same time stabilizing the queue of products against tipping in either a left or right lateral direction transverse to the longitudinal axis. When the items accommodated are wider than a minimum width clearance $W_0$ (indicated in FIG. 1B), respective opposed contact sections 19 of fences 14 apply a constant clamping force at the sides of each item. On the other hand, when the items accommodated are approximately equally wide or narrower than minimum width clearance $W_0$, as for widths $W_2$ and $W_3$ of containers B and C, contact sections 19 may serve as positioning guides, only applying a correcting force if and when a queued item is disturbed from an aligned position, and/or to align a queue of products initially positioned out of alignment when fences 14 are manually spread apart to permit their initial placement.

Each tray 12 also includes an advancing member illustrated as a pusher member 20 (shown in FIGS. 1B, 4), which is connected to tray 12 for forward and backward sliding movement biased in the forward direction by a suitable biasing component, which may be a flat spiral spring (not shown) mounted behind pusher member 20, analogously to flat spiral spring 97 of alternative trays 12', 12", described below. By varying a winding tightness at different positions along its length, a flat spiral spring may advantageously provide a variable force, which, for example, may range from about 2.5 lbf for a full queue of items to about 1.75 lbf for a single item, over an approximately 12-inch range of displacement. However, other types of springs or other suitable passive biasing mechanisms are possible within the scope of the invention, including but not limited to helical or other spring shapes, and stretch bands of rubber or other suitable material. In conjunction with an advancing member, illustrated as pusher member 20, tray 12 is provided with an item stop 26, illustrated as a small vertical panel positioned at the front end 18 of each tray lower support 15, which may conveniently support a small card slot 28 for holding a price or product description strip (not shown). Alternatively, a thin wire mounted or affixed in a suitable manner to tray 12, and disposed at a higher level than lower support 15, may serve as the principal item stop, as illustrated for trays 12', 12", and 12'" described further below, saving on the material cost of and limiting the view obstruction associated with making lower support 15 extend high enough to effectively stop the front item.

When a queue of items having a wider width dimension than minimum width dimension $W_0$ is supported by tray 12, the above-described clamping force applied by opposed contact sections 19 of fences 14 may produce friction to resist forward movement of the queue of items. This friction may advantageously assist in preventing excessive or undesired acceleration of an item or items on tray 12. The tendency for excessive acceleration to occur is greater the fewer the number of items remaining in the queue, i.e., the smaller the mass that is accelerated by the net pusher force.

It will be appreciated that a gravity feed without a spring-biased pusher is not similarly susceptible to the tendency of a smaller queue of items to be accelerated at a faster rate when the queue diminishes, as the gravity force decreases in proportion to the mass that it accelerates. However, a spring-biased pusher has certain other advantages over a gravity feed, such as providing an arbitrary desired amount of force, not limited at the upper extreme by a tangential component of the weight of the product queue; and permitting products in a queue to advance in an upright orientation in a horizontal direction, thus improving their visibility and attractiveness. In addition, a spring force that slightly varies with displacement can reduce the tendency of fewer items to accelerate faster, which may be undesirable.

Figure 1B:
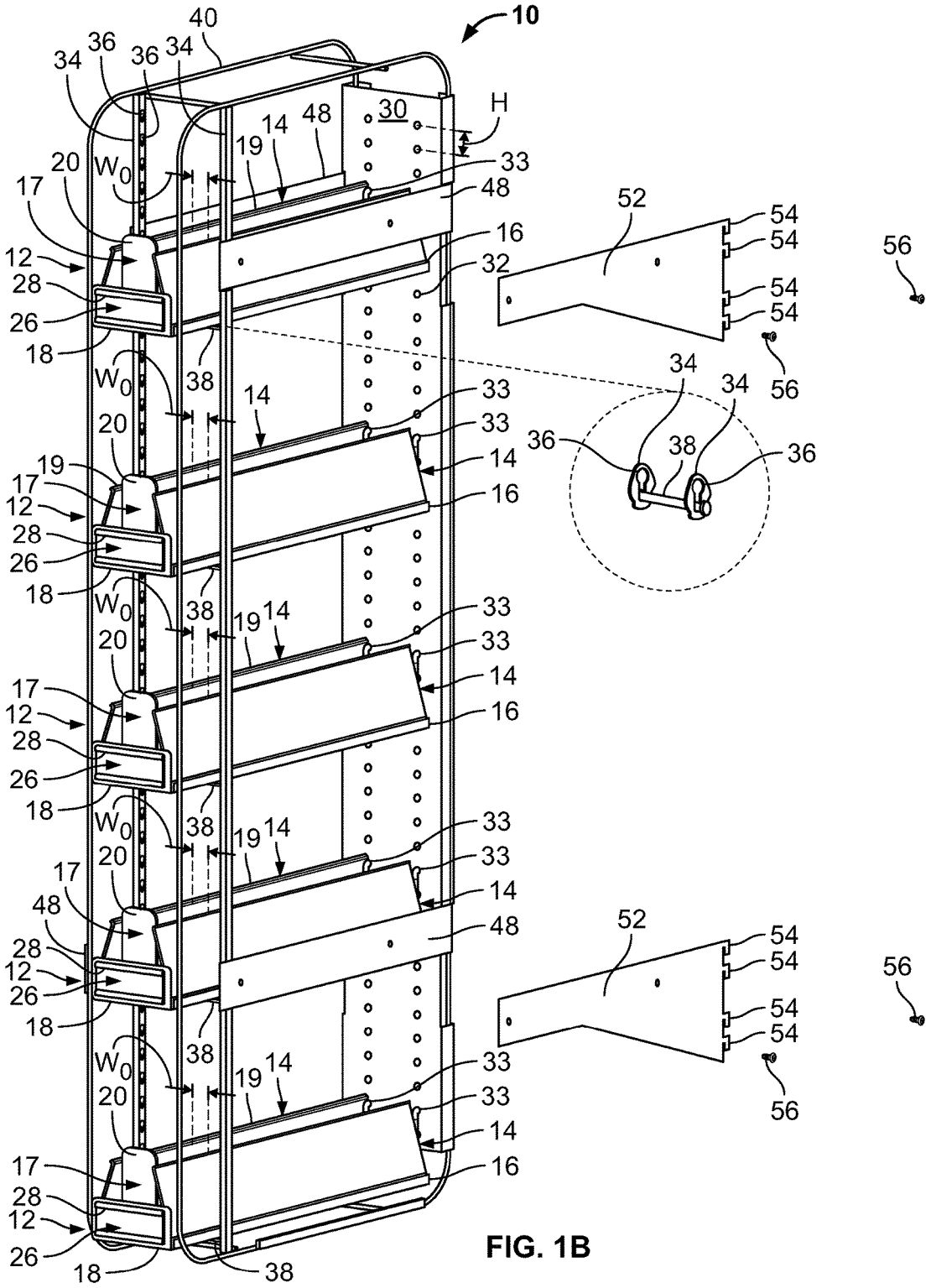
FIG. 1B is a partially exploded perspective view of the display shown in FIG. 1A, with merchandise items and graphic panels removed to reveal details of the trays and display frame.
Figures 2, 3:
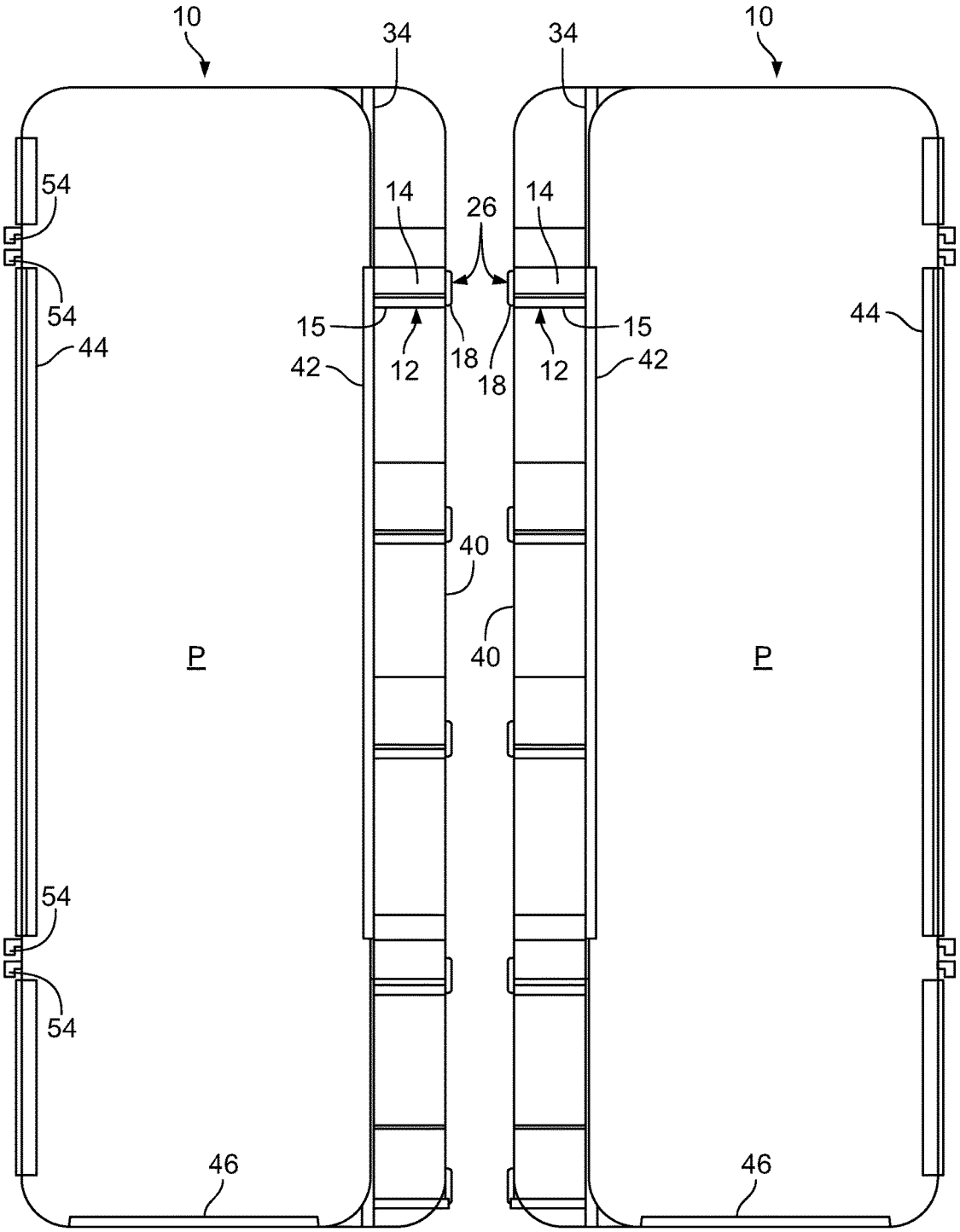
FIG. 2 is a right side elevation view of the assembled display shown in FIG. 1A.
FIG. 3 is a left side elevation view of the assembled display shown in FIG. 1A.
Figure 4:
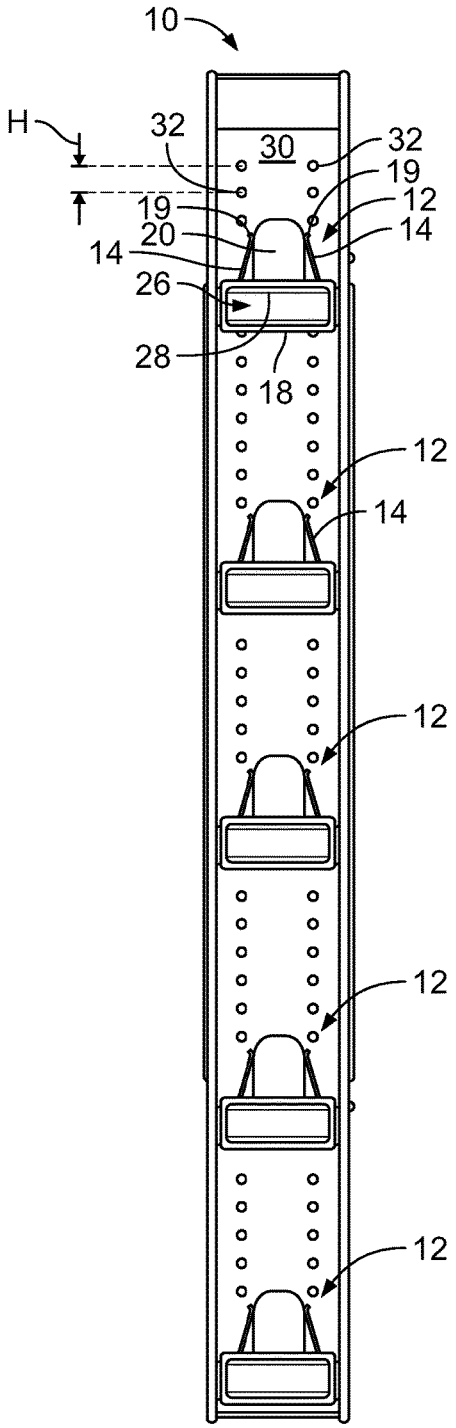
FIG. 4 is a front elevation view of the assembled display shown in FIG. 1A, with merchandise items removed.
Figure 5:
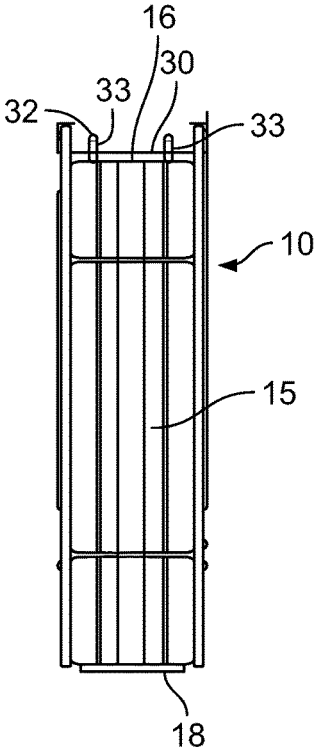
FIG. 5 is a top plan view of the assembled display shown in FIG. 1A, with merchandise items removed.

Display 10 provides for fine indexing height adjustments of trays 12, as illustrated in FIGS. 1B and 4. In particular, a rear mounting wall structure, illustrated as a rear wall channel 30, includes a plurality of mounting features, illustrated as holes 32, at a plurality of mounting locations spaced apart in small vertical height increments H. Height increments H are preferably smaller than the height of each tray 12, or that of a range of products typically supported thereon, so that a tray 12 can be adjusted slightly up or down to accommodate taller products supported thereon or on the next lower tray. This avoids the need to completely remove a tray 12 when products on the next lower tray 12 would otherwise slightly impinge lower support 15.

Each tray 12 may be solely supported in a cantilevered fashion from rear wall channel 30 by inserting a pair of mounting hooks 33 thereof into a selected pair of mounting holes 32. In this example, mounting holes 32 and hooks 33 are illustrated with a round cross section, but other shapes may be more desirable depending on the application. For example, a vertically oriented elongate cross section, such as a rectangular or I-beam cross section, may be preferred for enhanced bending strength for cantilever support of a heavy queue of items. Optionally, for additional support of trays 12, front channel uprights 34 may be provided with mounting features, illustrated as keyholes 36, at height positions corresponding to those of holes 32, to accommodate a removable crossbar 38 on which a front end of a respective tray 12 may rest. This additional support may be particularly advantageous when a heavy queue of items is supported on tray 12, whereas forgoing the cross bar for lighter item queue applications permits quicker repositioning of trays 12.

Display 10 additionally includes a wire cage 40, best seen in FIG. 1B, to which other structural and functional members may be attached. Such attached members may include the above-described rear wall channel 30 and front channel uprights 34, a front slot member 42, rear slot member 44, and lower slot member 46, which may, for example, be L- or U-channels, as appropriate for receiving respective front, rear, and lower edges of a full-length graphic panel P slidingly received between front and rear slot members 42, 44, as well as suitable display mounting structures for mounting the entire display 10 to a wall or fixture, such as store aisle shelving structure S. In particular, the illustrated embodiment includes a pair of fixed side mounting brackets 48 attached at each side of wire cage 40, to each of which a removable side mounting tooth bracket 52, including mounting teeth 54, may be attached by suitable fastening means, such as screws 56.

Figure 6:
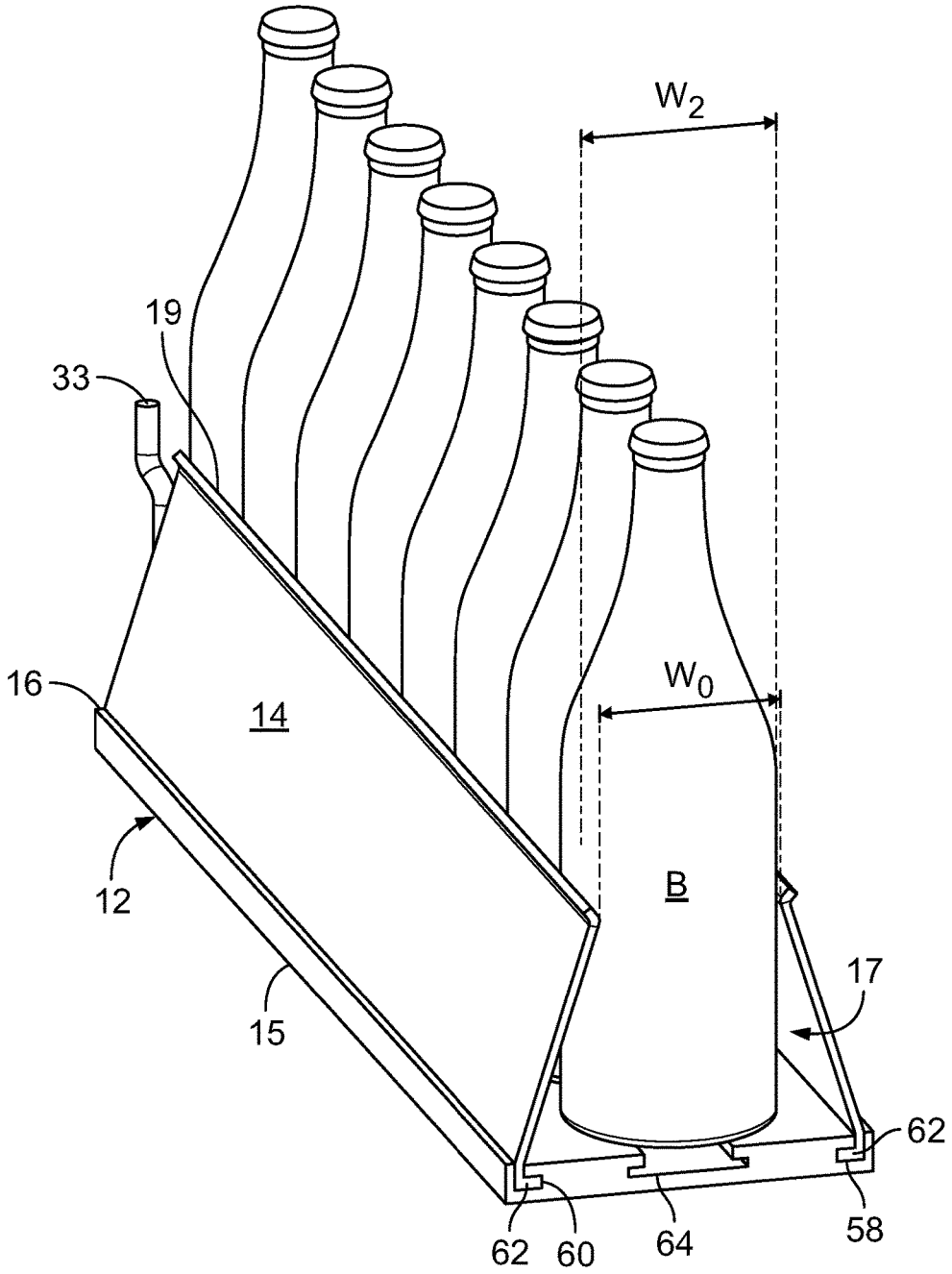
FIG. 6 is a perspective view of a dispensing tray of the invention as used in the display shown in FIG. 1A, supporting a queue of narrow containers.
Figure 7:
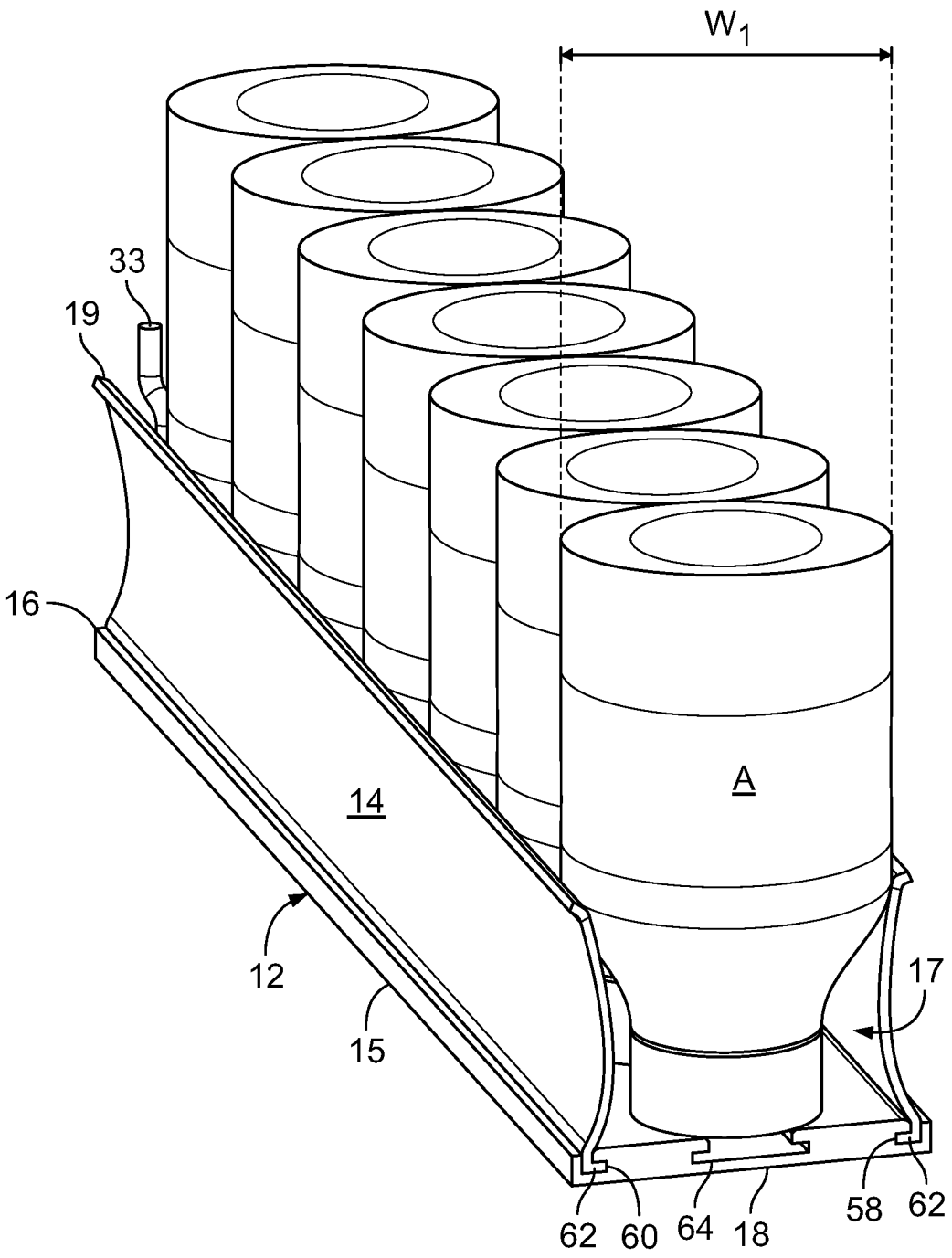
FIG. 7 is a perspective view of a dispensing tray of the display shown in FIG. 1A, supporting a queue of wider containers.

Illustrated in FIGS. 6 and 7, respectively, are a tray 12 supporting a queue of relatively narrow containers B and a tray 12 supporting a queue of wider containers A. Fences 14 of tray 12 are illustrated as unitary members formed of a single material, so that flexing stresses and strain (deformation) are substantially evenly distributed therealong, resulting in a relatively bent profile shape of fences 14 when they are flexed outwardly by wider items such as containers A, as shown in FIG. 7, as compared to a relatively straight profile shape of fences 14 when no items or narrower items are supported (in this case, fences 14 are relaxed in a relatively straight orientation, although being relaxed in a curved orientation may convey certain advantages discussed in more detail below).

As seen in FIG. 6, containers B retained in tray 12 are an illustrative example of a queue of items having an accommodated width $W_2$ approximately equal to or slightly less than a minimum width clearance $W_0$. In this embodiment, a minimum width clearance $W_0$ corresponds to a relaxed position of fences 14, in contrast to a minimum width clearance determined by a fence preload stop, as described below for trays 12', 12". In FIG. 7, in turn, containers A retained in tray 12 are an illustrative example of a queue of items having an accommodated width $W_1$ greater than minimum width clearance $W_0$.

In addition to an illustration of the flexing behavior of fences 14, a detailed illustration of functional longitudinal channels formed in lower support 15 is provided in FIGS. 6 and 7. Generally L-shaped fence retaining channels, designated as a left fence channel 58 and a right fence channel 60, are formed at left and right sides of lower support 15 to receive L-shaped lower ends 62 of fences 14. This modular tray construction facilitates swapping out fences 14 for an alternate fence or fences (referred elsewhere as alternate side support) of other desired shapes, materials, or properties (not shown), fence 14 and the alternate fence(s) having L-shaped lower ends compatible with channels 58, 60. In addition, an upside-down T-shaped channel 64 is configured to slidingly receive a complementary male feature of pusher member 20 (not shown, though an analogous arrangement is illustrated for alternative trays 12' and 12", described below).

Fences 14 may be formed of any suitable flexible elastic material, including but not limited to flexible elastic polymers, such as PVC, ABS, or metals, such as steel. Lower support 15 is preferably formed of a lightweight and durable material, such as high-impact polystyrene (HIPS), other styrenes, PVC, ABS, or similar. Wires, beams, upright channels, and other structural members of display 10 are preferably steel, aluminum, or similar high strength material.

Turning to FIGS. 8A-24, an alternative display 10', configured to support any of alternative trays 12', 12", and 12'", is illustrated. Components that make up display 10', and subsets thereof, are illustrated in several assembled and exploded views in FIGS. 8A-14, while trays 12', 12", and 12'" (FIG. 20B) are shown in greater detail in FIGS. 15A-24.

Turning to FIGS. 8A-14, alternative display 10', analogously to display 10, includes a wire cage 65 which supports a plurality of trays 12', 12", 12'" and a plurality of graphic panels P. A rear wall channel 67 is attached to rear vertical wire sections of wire cage 65 for cantilevered mounting of trays 12', 12", 12'" thereto. A pair of side mounting brackets 69 are attached at upper and lower positions at each side of wire cage 65, for fastening a pair of tooth bracket assemblies 71, 71' fastenable to the right or left side mounting brackets 69 by suitable fasteners 75 to mount display 10' at a selected side.

Figure 8A:
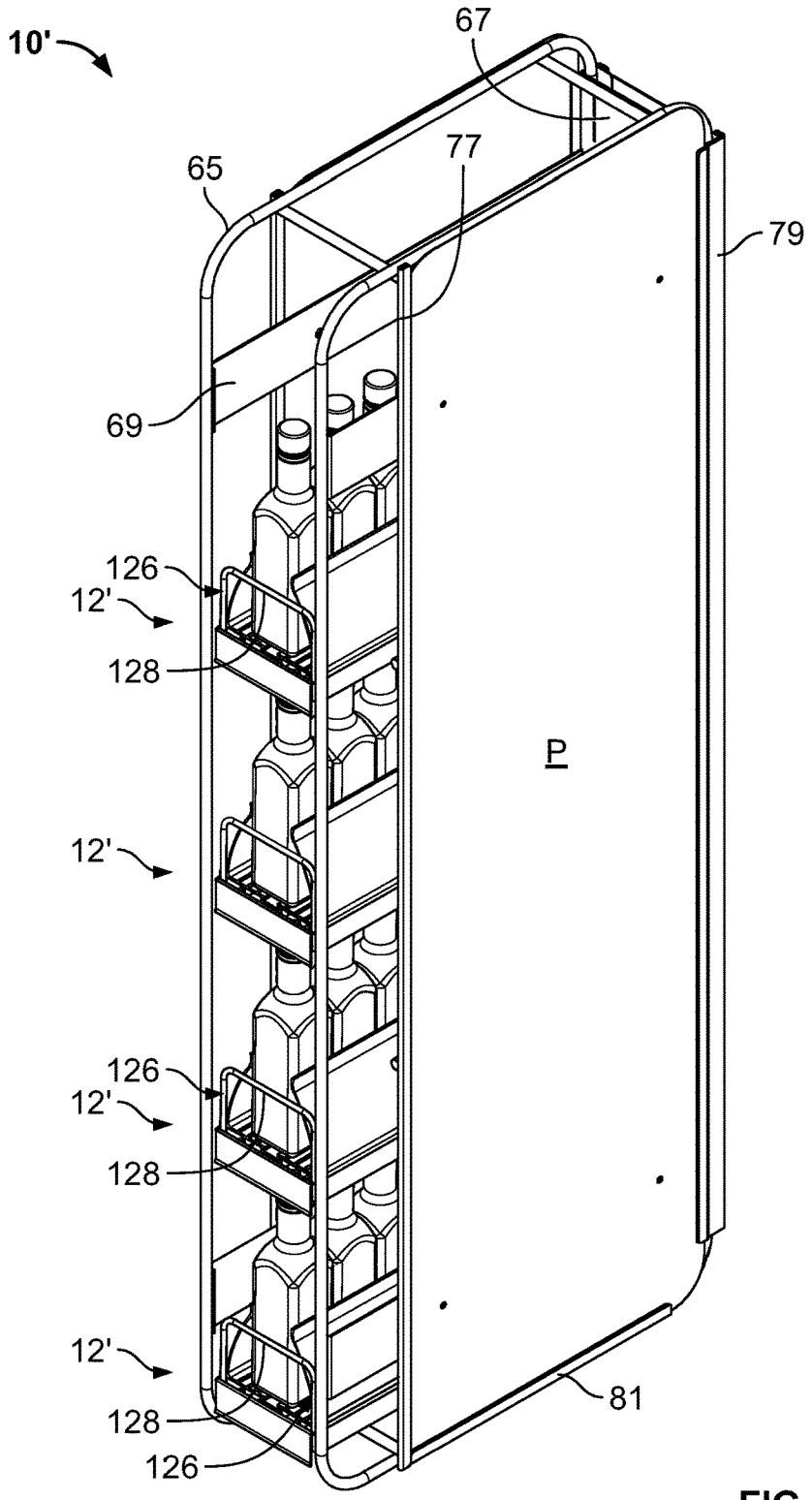
FIG. 8A is a perspective view of another display according to the invention supporting queues of merchandise items.
Figure 8B:
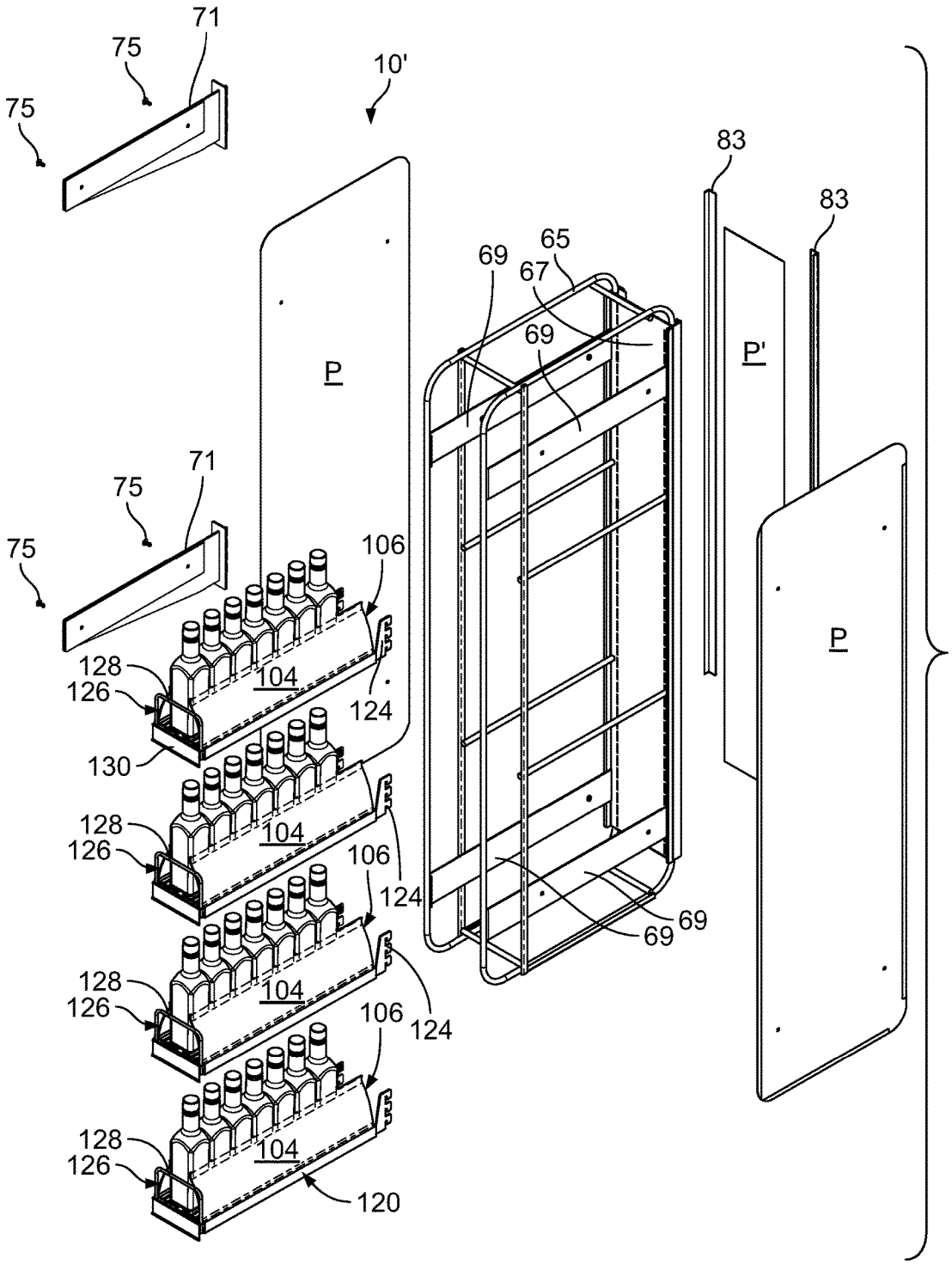
FIG. 8B is an exploded perspective view of the display shown in FIG. 8A, showing the exploded orientations of mounting brackets for a right configuration.
Figure 9A:
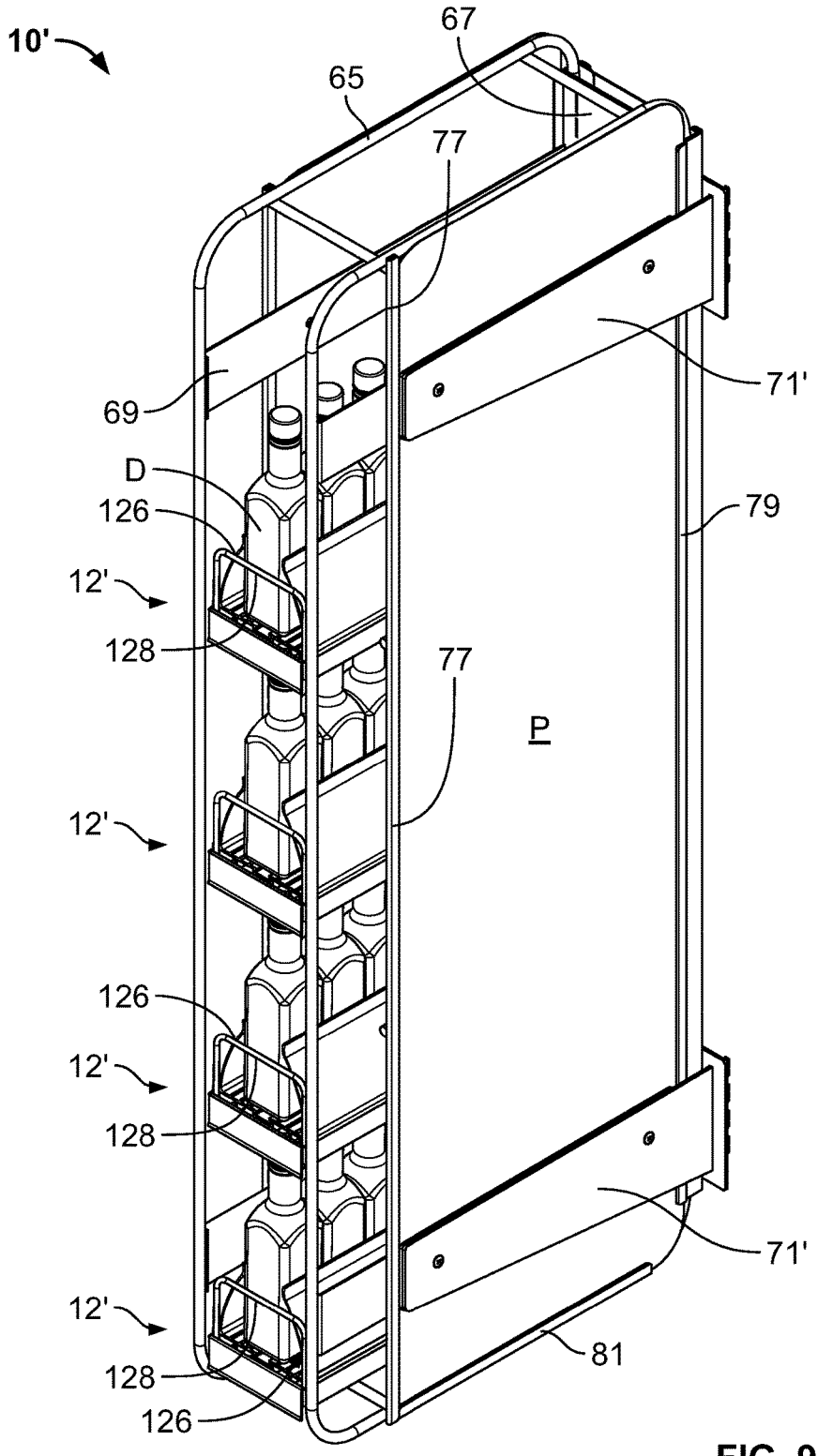
FIG. 9A is a perspective view of the display shown in FIG. 8A, showing mounting brackets connected thereto for a left configuration.
Figure 9B:
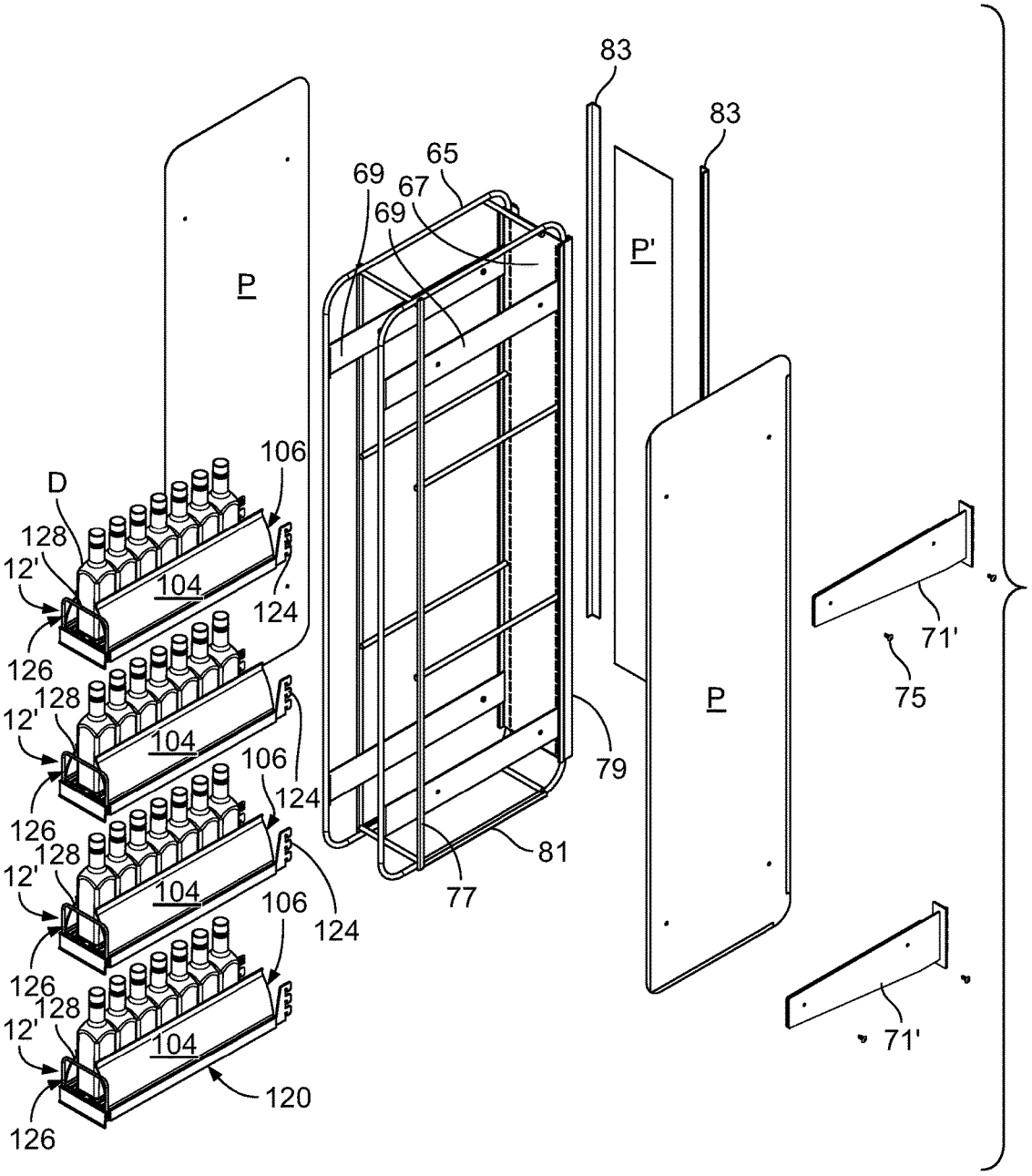
FIG. 9B is an exploded perspective view of the left configuration illustrated in FIG. 9A.
Figure 12:
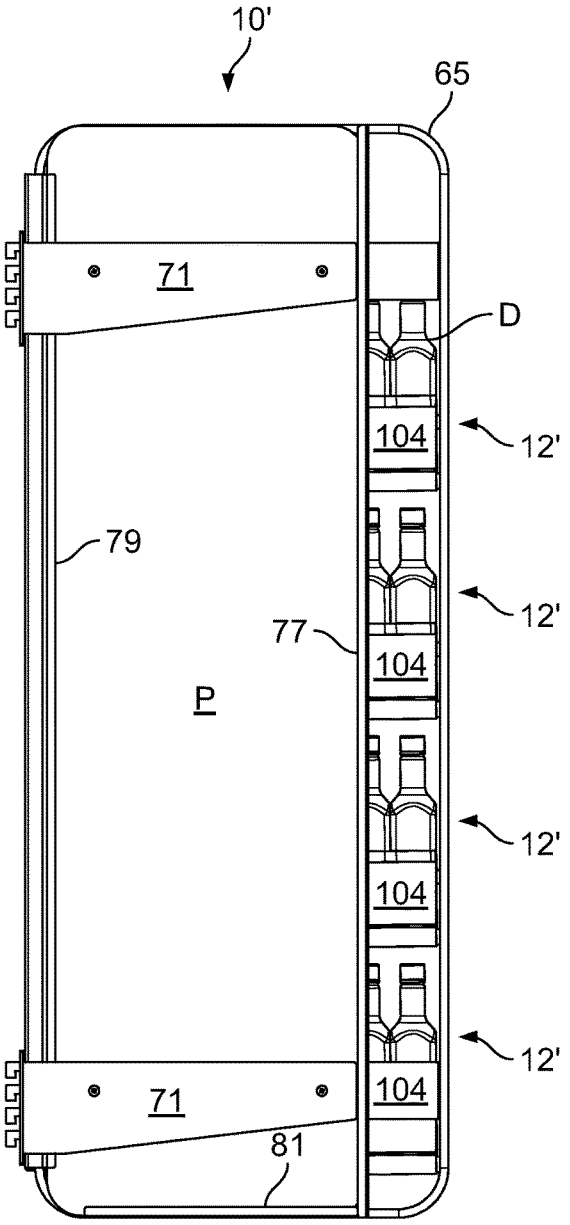
FIG. 12 is a right side elevation view of the display in the right configuration.
Figure 13:
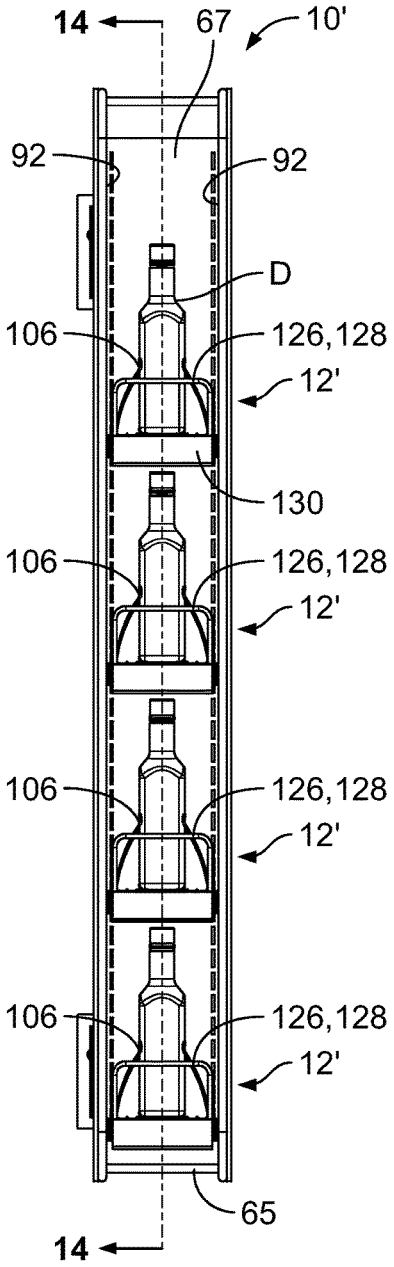
FIG. 13 is a front elevation view of the display in the right configuration.
Figure 14:
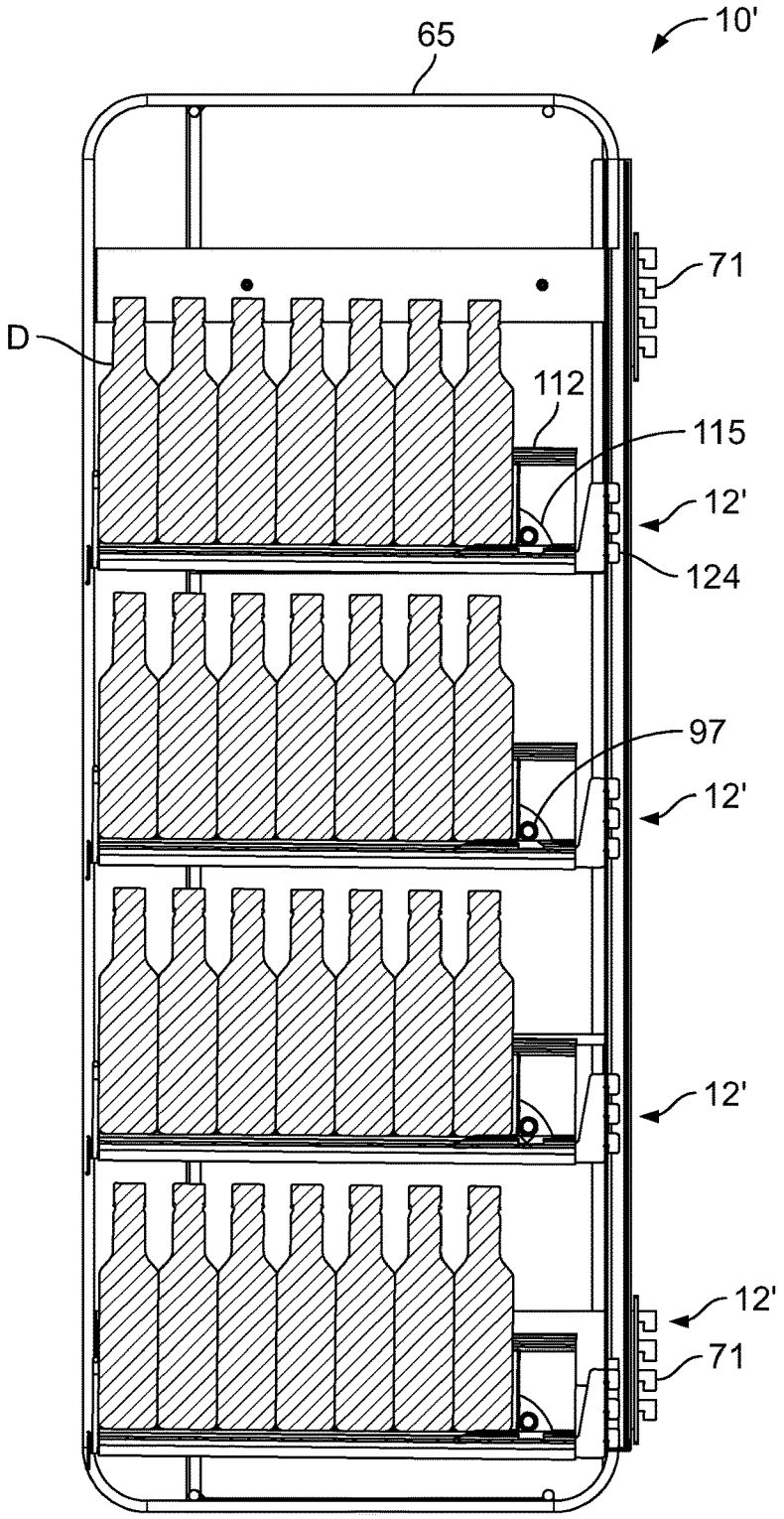
FIG. 14 is a sectional left side elevation view of the display shown in FIG. 8A.

FIGS. 8A and 8B illustrate assembled and exploded perspective views of a left configuration of display 10', in which tooth bracket assemblies 71 are mounted at the right side of wire cage 65, so that display 10' may be hung with a left-facing outwardly displayed graphic panel P at an end cap location. Right, front, and sectional left side elevation views of the left configuration of display 10' are shown in FIGS. 12-14. FIGS. 9A and 9B illustrate a right configuration, in which mirror-image tooth bracket assemblies 71' are mounted at the left side of wire cage 65, for a right-facing display. Possible constructions of tooth bracket assemblies 71 and 71' are shown in the exploded views of FIGS. 11A and 11B, respectively. Each tooth bracket assembly 71, 71' includes a tooth bracket 94, a tooth bracket positioning plate 96, and a respective tooth bracket spacer 98, 98' attached to its respective left or right side. These parts may, for example, be welded together to form the respective tooth bracket assembly 71, 71'. Alternatively, tooth bracket assemblies 71 and 71' may be symmetrical, so as to attach interchangeably at either side of display 10'. In general, it is desirable for display 10' not to be "sided", but to be able to mount in a left or right configuration with little to no substitution of components.

Suitable front, rear, and lower slot members 77, 79, 81, which may, for example, be L- or U-channels as desired, are attached to each side of wire cage 65 for slidingly receiving and retaining front, rear, and lower edges of side graphic panels P. Similarly, vertically aligned back slot members 83 are also provided for slidingly receiving and retaining side edges of a back graphic panel P', while a lower edge of graphic panel P' may, for example, be received in an upturned portion 90 of rear wall channel 67 (shown in FIG. 10B, or in an appropriate lower back graphic slot member (not shown).

Figure 10A:
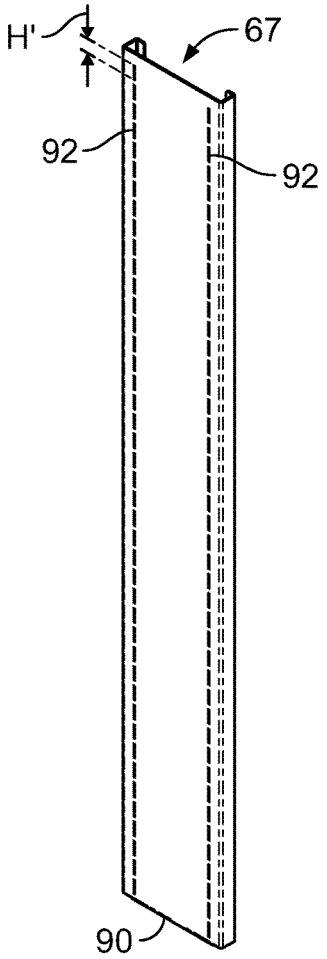
FIG. 10A is a perspective view of a rear mounting panel of the display shown in FIG. 8A.
Figure 10B:
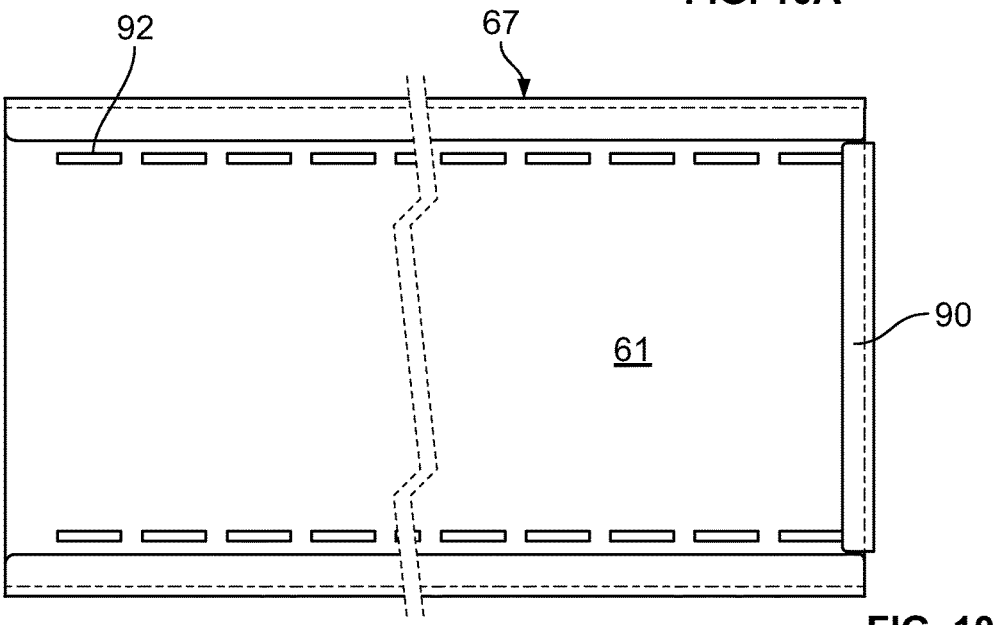
FIG. 10B is a rotated rear elevation view of the mounting panel shown in FIG. 10A.
Figure 11A:
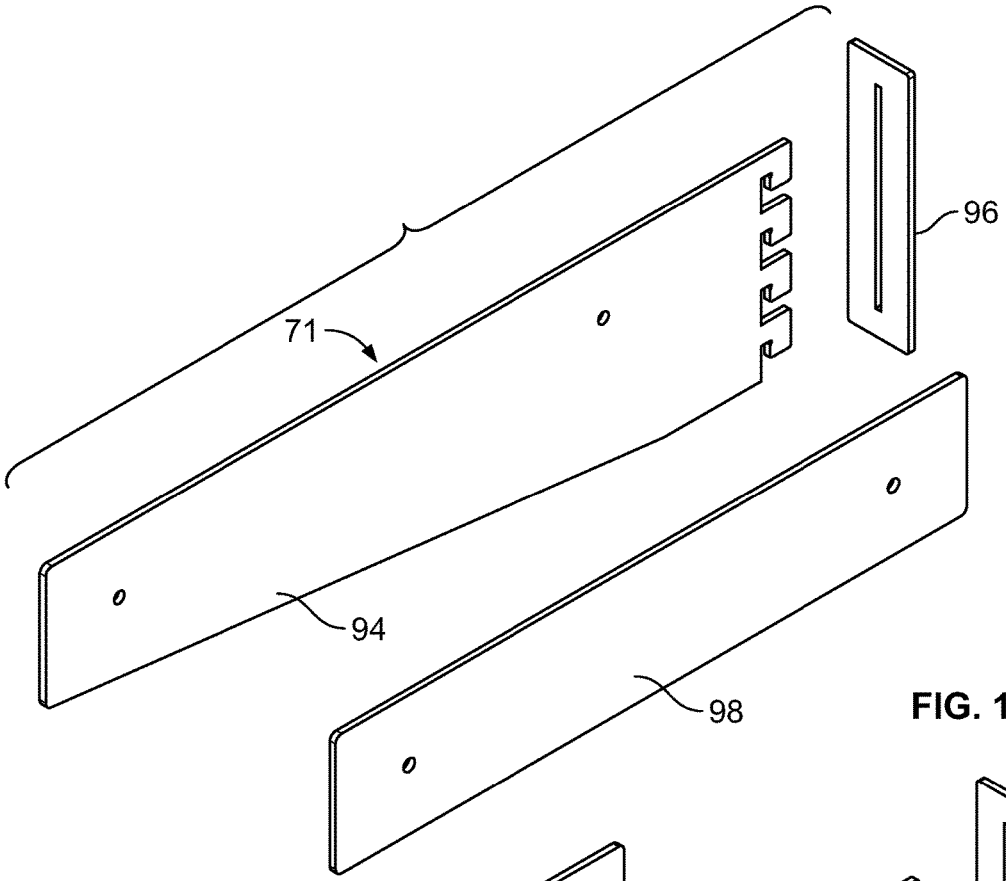
FIG. 11A is an exploded perspective view of a mounting bracket for the right display configuration illustrated in FIG. 8B.
Figure 11B:
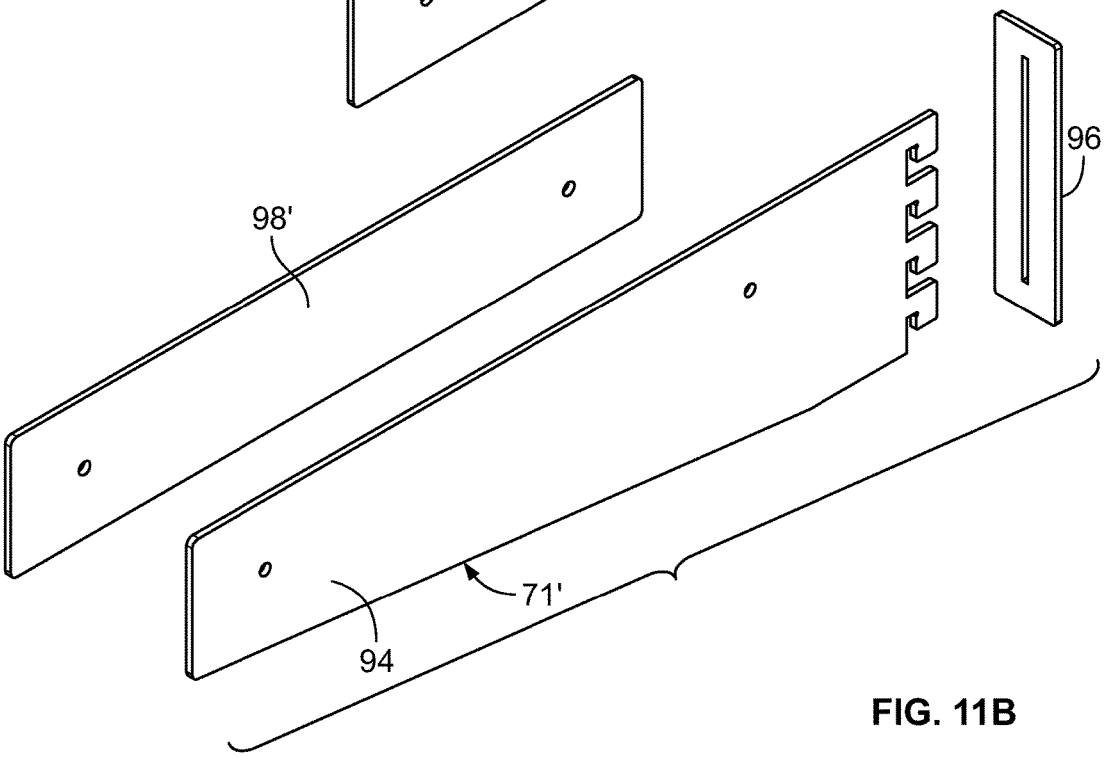
FIG. 11B is an exploded perspective view of a mounting bracket for the left display configuration illustrated in FIGS. 9A and 9B.

With reference to FIGS. 10A, 10B, and 14, rear wall channel 67 includes a plurality of mounting features, illustrated as mounting slots 92, at a plurality of mounting locations spaced apart in small vertical height increments H'. As for height increments H of display 10, height increments H' are preferably smaller than the height of each tray 12', 12", 12'", and smaller than that of a range of products typically supported thereon, so that a tray 12', 12", 12'" can be adjusted slightly up or down to accommodate taller products supported thereon or on the next lower tray.

Figure 15A:
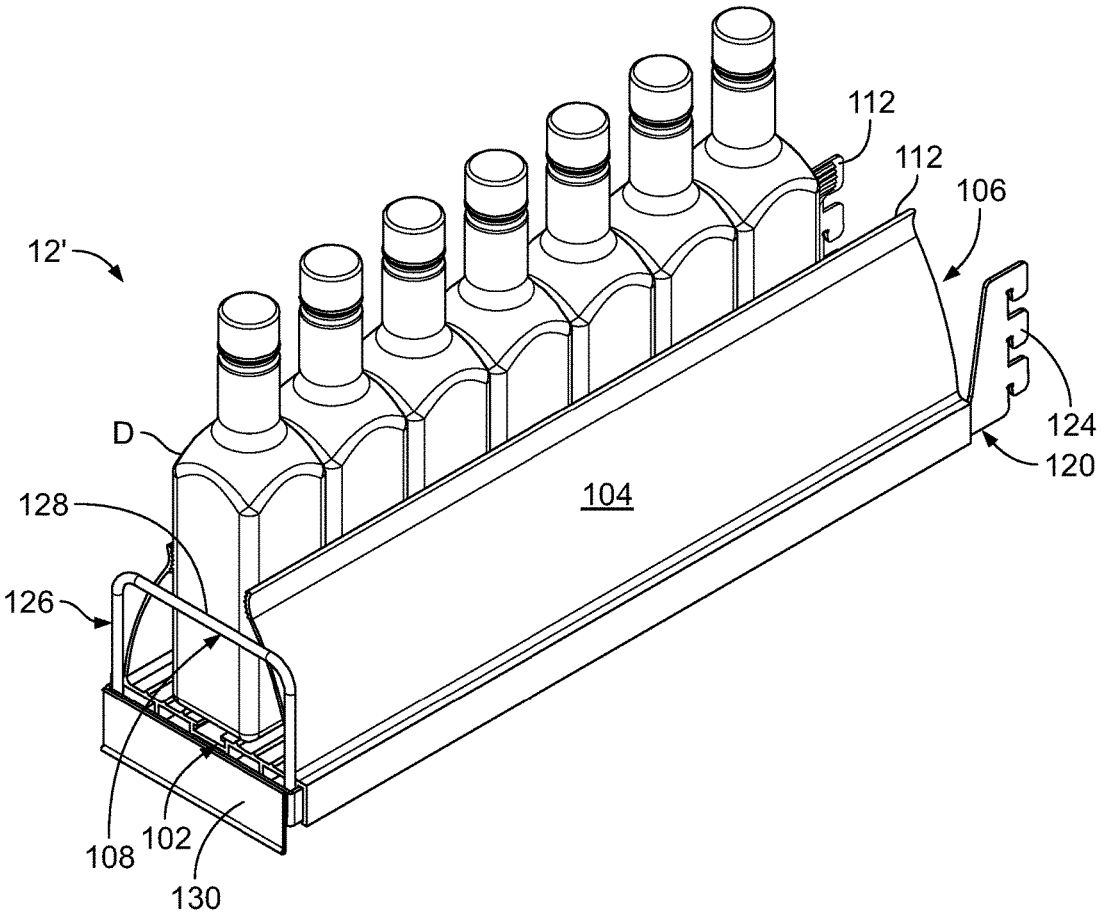
FIG. 15A is a perspective view of a dispensing tray assembly of the invention as used in the display shown in FIG. 8A, supporting a queue of containers.
Figure 15B:
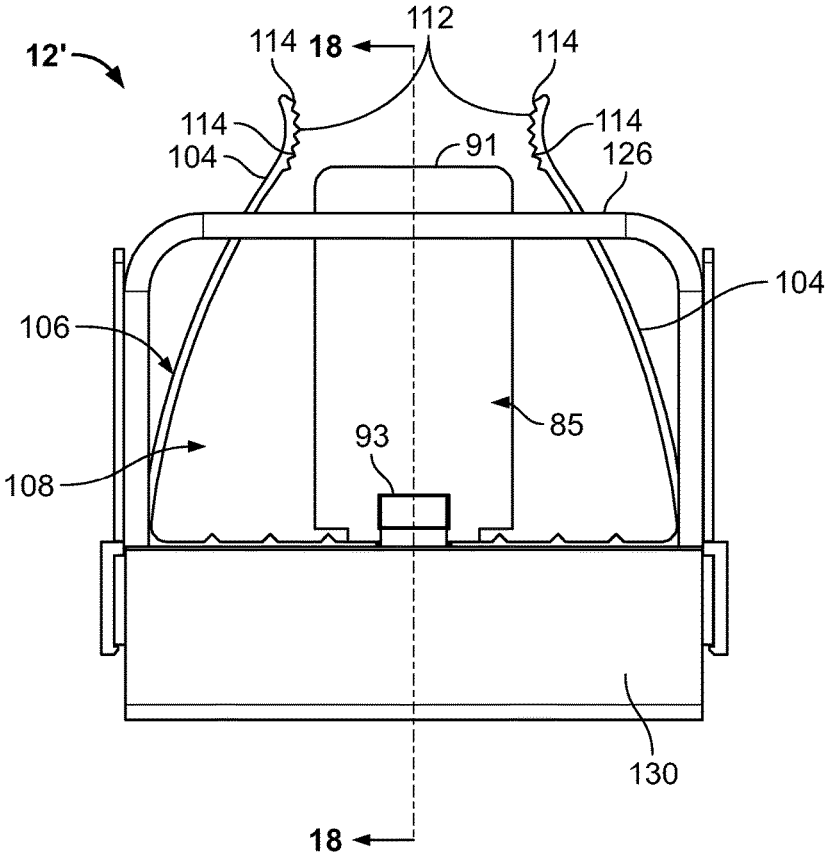
FIG. 15B is a front elevation view of the dispensing tray assembly shown in FIG. 15A.
Figure 15C:
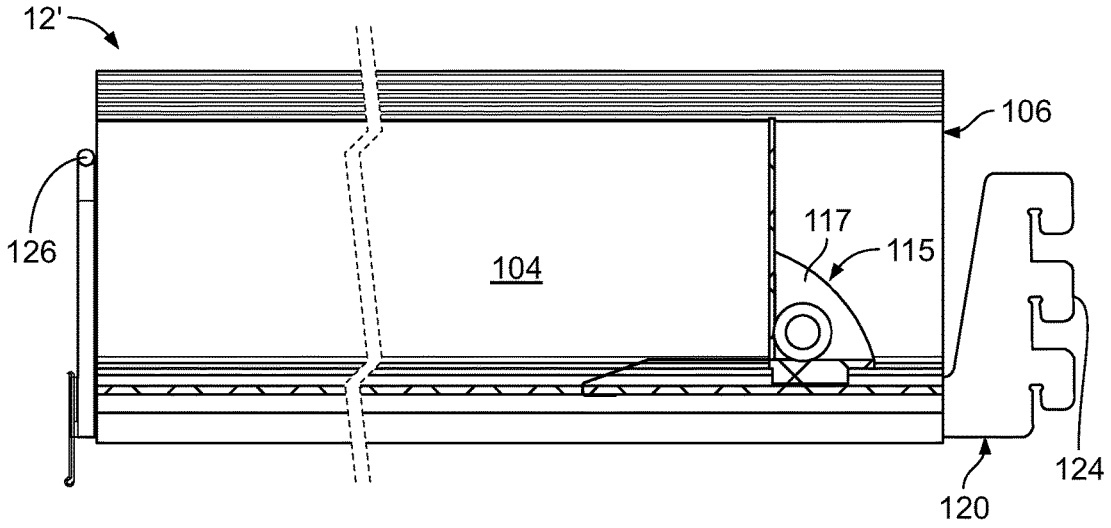
FIG. 15C is a left side elevation view of the dispensing tray assembly shown in FIG. 15A.
Figure 16:
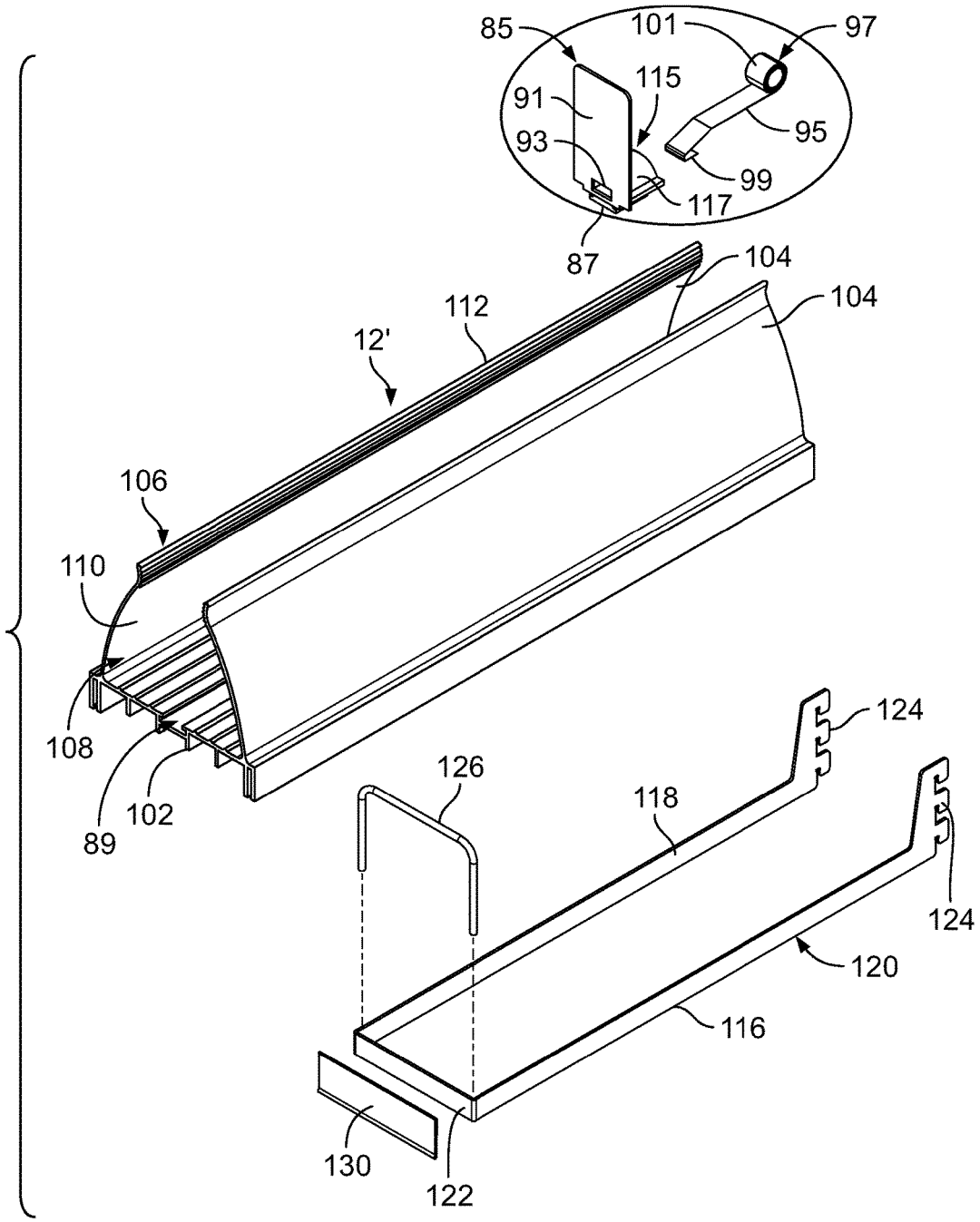
FIG. 16 is a partially exploded perspective view of the dispensing tray assembly shown in FIG. 15A.
Figure 17:
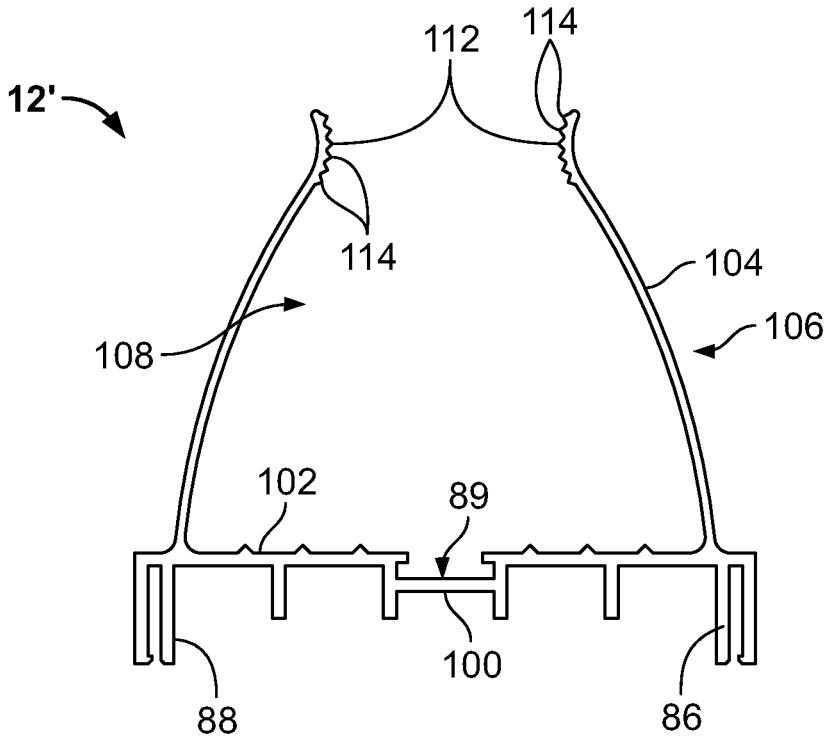
FIG. 17 is a front elevation view of another one-piece dispensing tray of the invention.
Figure 18:
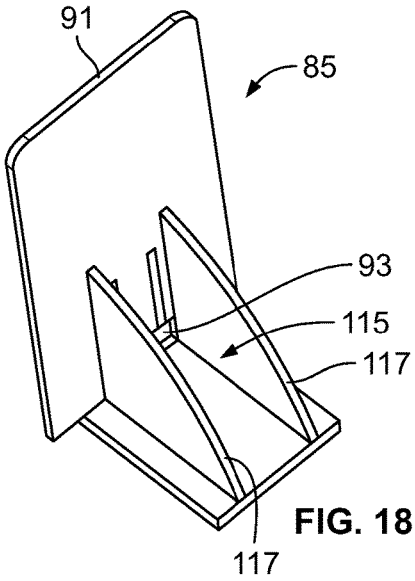
FIG. 18 is a rear perspective view of a pusher member of the dispensing tray assembly shown in FIG. 15A.

Turning to FIGS. 15A-24, detailed features of trays 12', 12", 12'" are illustrated in detail. FIGS. 15A-18 are illustrations of tray 12' and of features and components common to trays 12', 12", 12'". As best seen in FIGS. 15B, 16 and 17, tray 12' is mainly characterized by its incorporation of a lower support 102 and deflectable side fences 104 in a one-piece feed channel member 106, defining an item feed channel 108 for supporting, retaining, and aligning items in a merchandise queue. Feed channel member 106 may, for example, be formed by extrusion from a stiff plastic material, such as HIPS. Thus, the flexing strain of side fences 104 will be distributed along substantially the entire vertical length thereof, as with side fences 14. However, side fences 104 differ from side fences 14 in that they include a significant concave curved section 110 facing inwardly toward feed channel 108, which is thought to enhance stiffness of side fences 104 in outward bending, as well as generally maintaining contact on the sides of supported items within a relatively narrow, inwardly convex contact band 112 near an upper end of each side fence 104, where gripping ribs 114 may optionally be formed. That is, items retained between fences 104 and having a width dimension profile that ranges from being inwardly tapered toward a lower end from the height of contact band 112, to being generally straight up and down, to being outwardly tapered toward the lower end, but at a steeper angle than that of fences 104, when the latter are flexed outwardly, will touch contact bands 112, but no other part of fences 104, as the items are supported and dispensed. One example of such an item profile is the generally straight up and down profile of a lower gripped/retained portion of containers D shown in FIG. 15A.

Pusher and hanger components of tray 12', and their relationships to feed channel member 106, are illustrated in the exploded view of FIG. 16. A unitary pusher member 85 of tray 12' is shown to include a male T-shaped rib 87, configured to be received in a complementary female T-shaped channel 89 of lower support 102, an upright pusher paddle 91, a spring-receiving slot 93 permitting the passage therethrough of an unwound portion 95 of a flat spiral spring 97, and a spring retaining seat 115 comprising a pair of spaced apart wall sections 117 shown in FIGS. 15C and 18. Flat spiral spring 97 includes a hooked end 99 configured to hook over a front end of thin horizontal section 100 of lower support 102, defining a bottom side of channel 89, as shown in FIGS. 16 and 17 and as analogously shown in FIG. 19A for tray 12", while a wound portion 101 is positioned behind pusher paddle 91, its winding tendency producing a forward biasing force to pusher member 85.

A pair of lower support beam receiving slots 86, 88 are formed in feed channel member 106 below lower support 102 (indicated, for example, in FIGS. 16 and 17), for receiving respective left and right support beams 116, 118 of a tray hanger 120. Left and right support beams 116, 118 are joined at their respective front ends by a front support beam 122, producing a horizontal U-shaped configuration of the three support beams. Extending upwardly from a rear end of each support beam 116, 118 is a toothed rack 124 configured to mate with mounting slots 92 of rear wall channel 67 for cantilevered support of trays 12'. An item stop 126 is comprised of a wire U-loop attached in a suitable manner, such as by welding, to the front end of tray hanger 120, a horizontal section 128 thereof configured to be spaced above a front end of lower support 102 by an appropriate height to effectively stop items as they reach a frontal dispensing position on tray 12', such as approximately the height of pusher paddle 91, as shown in FIG. 15B. A shelf price strip 130 is attached to tray hanger 120 in a lower position at or near front support beam 122, to avoid obstructing a frontal view of items on tray 12'.

In other embodiments, the side fences of an item tray comprise a rigid member that is made to be deflectable relative to a lower support of the tray (and items supported thereon) by connecting a discrete spring element between the rigid member of one or both side fences and the lower support. In this context, by "rigid" material, it is simply meant that, during normal use, the material does not flex or only flexes by an insignificant amount compared to the spring element. Two examples of an item tray having such compound or modular side fences are illustrated as trays 12", 12''', described in the following paragraphs with reference to FIGS. 19A-24.

Figure 19A:
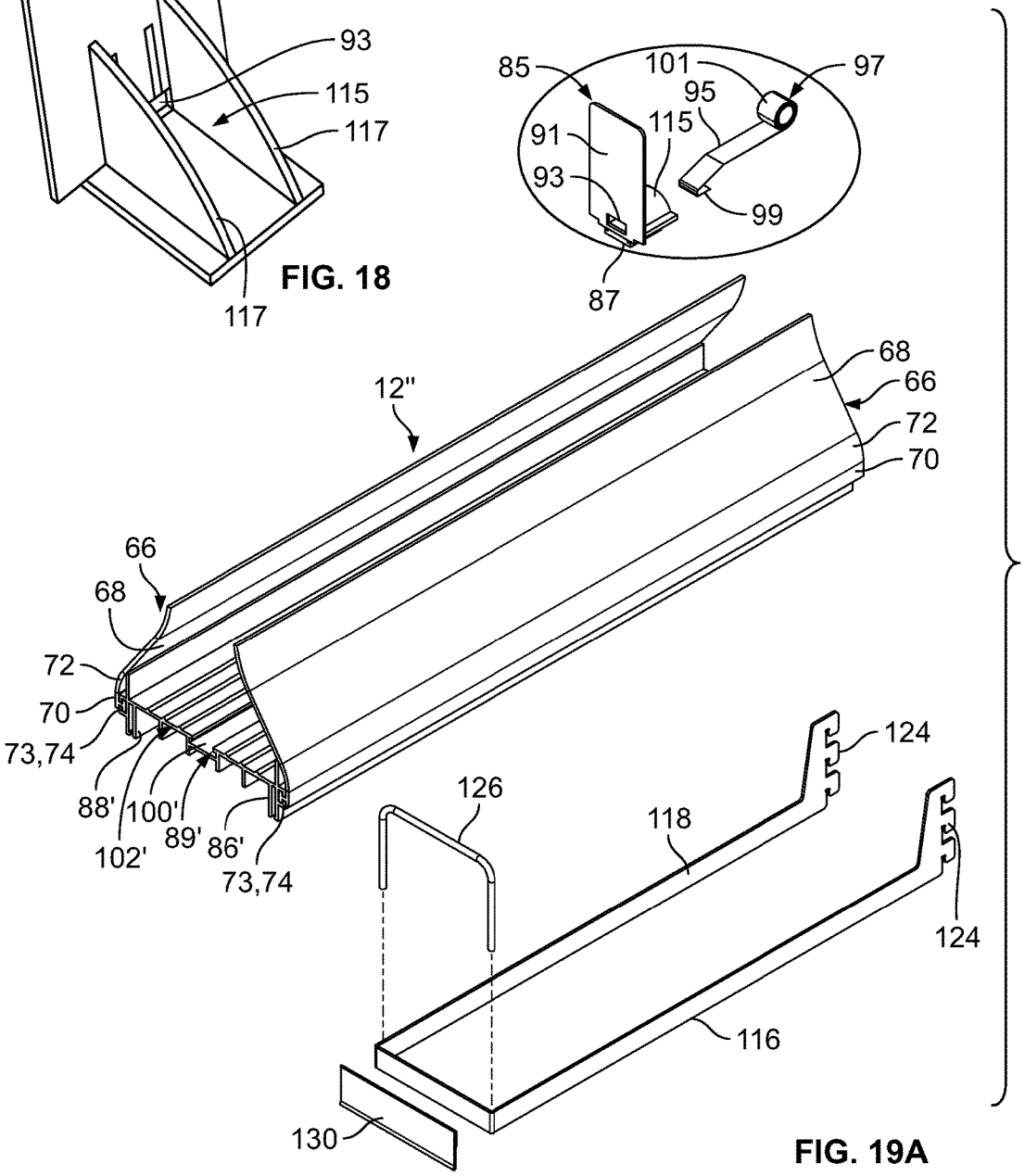
FIG. 19A is a partially exploded perspective view of another dispensing tray assembly of the invention.
Figure 19B:
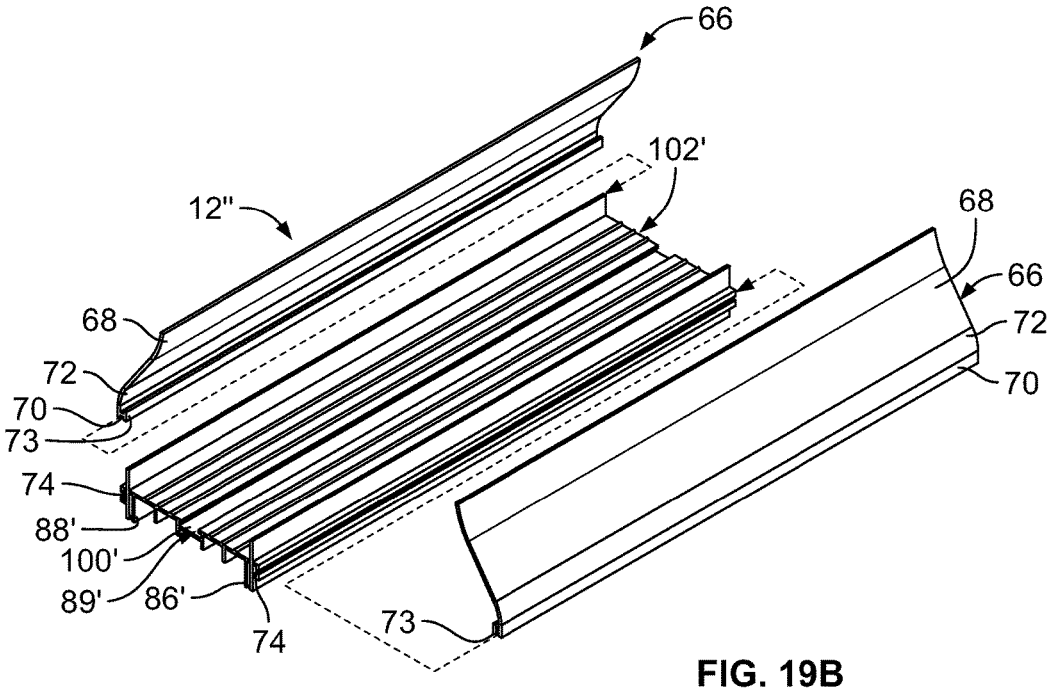
FIG. 19B is an exploded perspective view of a channel subassembly of the dispensing tray assembly shown in FIG. 19A.

Shown in FIG. 19A is an exploded assembly view of tray 12". Pusher 85, spring 97, are the same as described above, and are configured to be retained in a channel 89', with a corresponding thin horizontal section 100', of a lower support 102' of tray 12" in a similar manner. Likewise, tray hanger 120 and its components are the same, and lower support 102' has lower support beam receiving slots 86', 88' for receiving tray hanger 120 in the manner described above.

However, tray 12" differs from tray 12' and tray 12 in the features and mounting of its fence 66. Rather than being formed of a single material, fence 66 comprises a rigid contact section 68 and rigid connecting section 70, joined together by an intermediate flexible hinge section 72 (a type of elastically deformable biasing member) formed of a different material. Any suitable rigid and flexible materials may be selected for these respective sections, such as a rigid clear vinyl for the contact and connecting sections 68, 70 and flexible PVC for the flexible hinge section 72, in which case the three sections may be formed and fused together by coextrusion.

Other suitable methods of joining the three sections, depending on the materials used, may include welding, overmolding, adhesive bonding, or mechanical fasteners. Other embodiments of a multi-material fence may comprise a two-tiered structure in which a connecting feature is formed of the same flexible material as a hinge section, or in which a more flexible material is used for a contact/hinge section and a more rigid material used only for a connecting section. Alternatively, more than three tiers may be employed, such as a five-tiered structure with two intermediate flexible hinge sections instead of only one. In still another embodiment, multi-material fences like fence 66 or any of the aforementioned variations may be permanently attached, fused, or bonded to the corresponding lower support, rather than removably retained by a mating channel connection.

In addition to its different structure, fence 66 is mounted differently than fence 14. In particular, fence 66 is mounted in a preloaded state instead of a relaxed state. In its relaxed state, illustrated in dashed lines in FIG. 20A, flexible hinge section 72 of fence 66 forms a 180° arc. Fence 66 is mounted by first flexing it outwardly through a preload flex angle F, and then inserting a T-shaped connecting rib 73 of connecting section 70 into a complementary T-shaped channel 74 formed in lower support 102' of tray 12", with a lower portion of contact section 68 braced against a preload stop rib 78 extending upwardly from lower support 102' to maintain a preload stress state in flexible hinge section 72. In this manner, when an item having a width dimension greater than a minimum/preload width clearance $W_p$ between fences 66 in their initial mounted positions is inserted between fences 66, fences 66 will respond immediately with a desired clamping force, determined by the height and positions of stop ribs 78. Optional features that may be incorporated into alternative fences 66' are shown in FIG. 20C, including an upper insertion region 80 that is flared outwardly to facilitate insertion of items slightly larger than preload width clearance $W_p$ but narrower than an insertion clearance $W_i$ between upper ends 82 of a pair of fences 66', by simply inserting the item between the upper ends and pressing the item downwardly to deflect fences 66' outwardly by a camming action. In addition, upper insertion region 80 includes gripping ribs 84, which may or may not be formed of a separate, higher friction material than the rest of upper insertion region 80, such as a durable silicone or other suitable elastomer, to enhance frictional damping of the pushing force; or a separate, lower friction material, such as nylon, PTFE, or similar, to reduce the amount of pushing force required to overcome friction.

Figure 22:
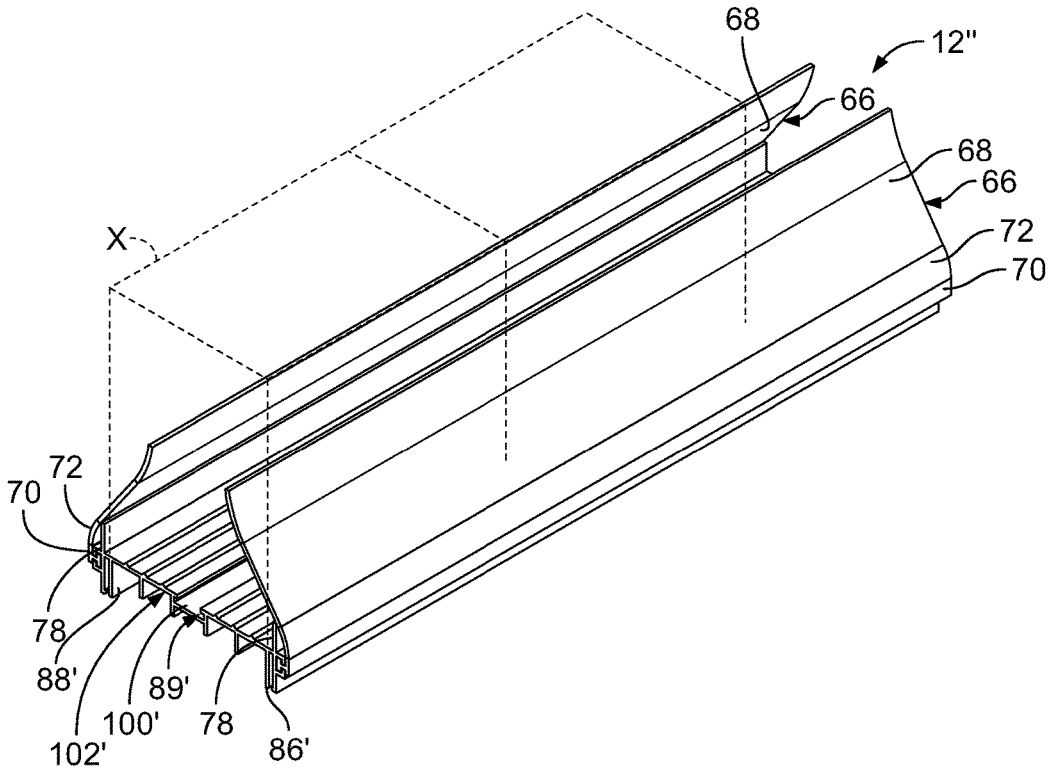
FIG. 22 is a perspective view of the channel subassembly shown in FIG. 19B, illustrating the position of a rectangular item that may be retained in the channel subassembly.
Figure 23:
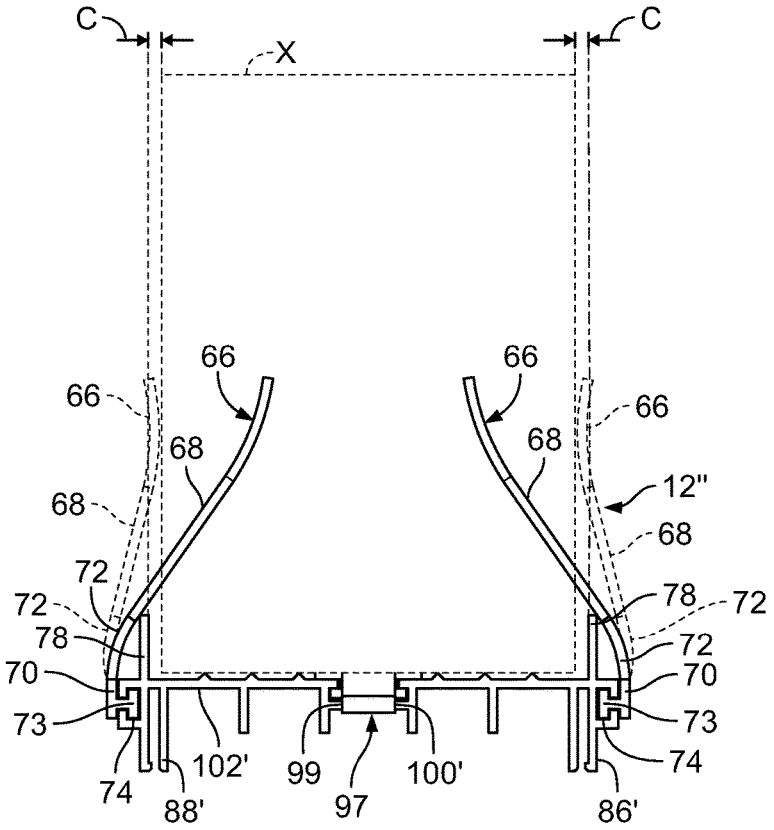
FIG. 23 is a front elevation view of the channel subassembly and position of the rectangular item shown in FIG. 22.
Figure 24:
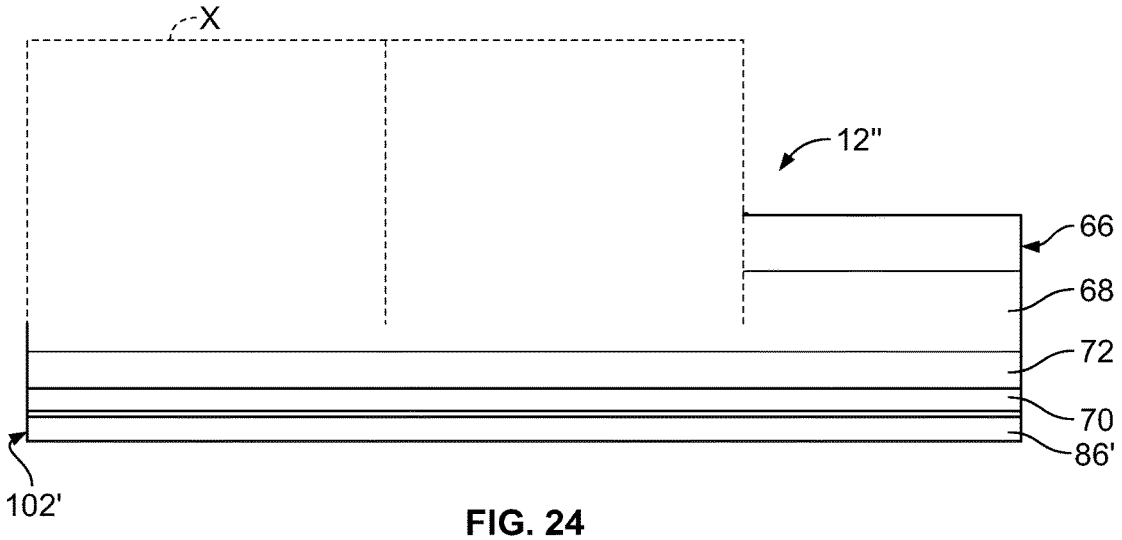
FIG. 24 is a left side elevation view of the channel subassembly and position of the rectangular item shown in FIG. 22.

Conveniently, in addition to serving as preload stops, ribs 78 also provide a secondary function as position guides for queueing items of a width approaching a largest width accommodated by tray 12", such as a box X illustrated in dashed lines in FIGS. 22-24. Thus, an approximately equal clearance C should be observed on both sides of box X when box X is positioned for queueing, and if only one lower side edge of box X abuts a rib 78, this will indicate misalignment, which may, for example, be a sign of damage, wear, or incorrect mounting of one of fences 66 or of lower support 102'.

Figure 20A:
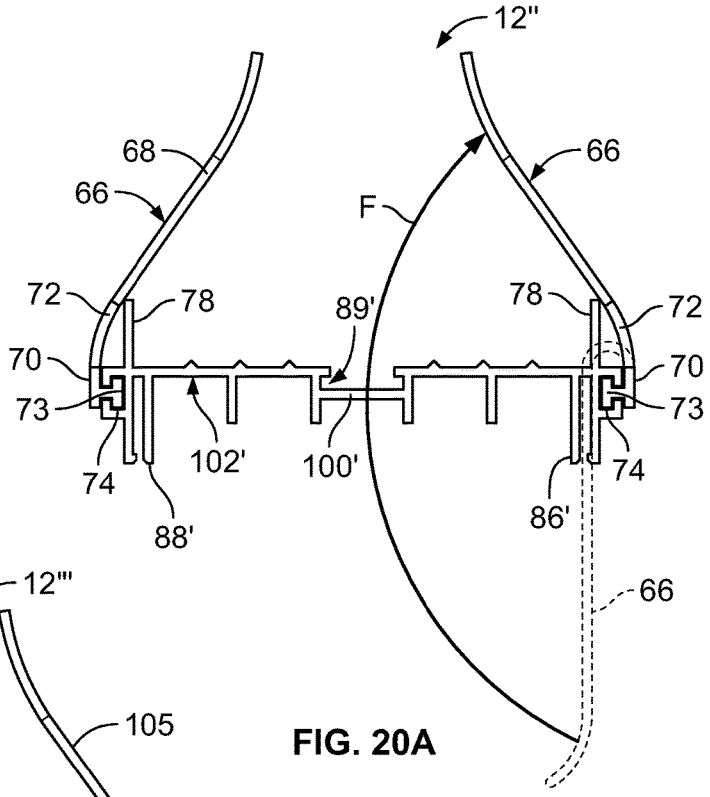
FIG. 20A is a front elevation view of the channel subassembly shown in FIG. 19B, illustrating the preloading deflection of a deflectable fence thereof.
Figure 20B:
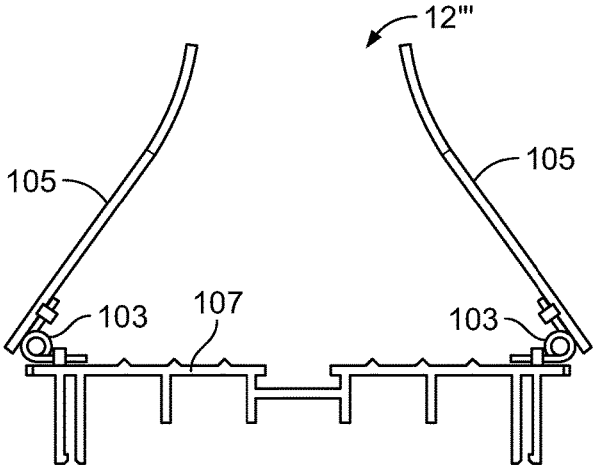
FIG. 20B is a front elevation view of another channel subassembly.
Figure 20C:
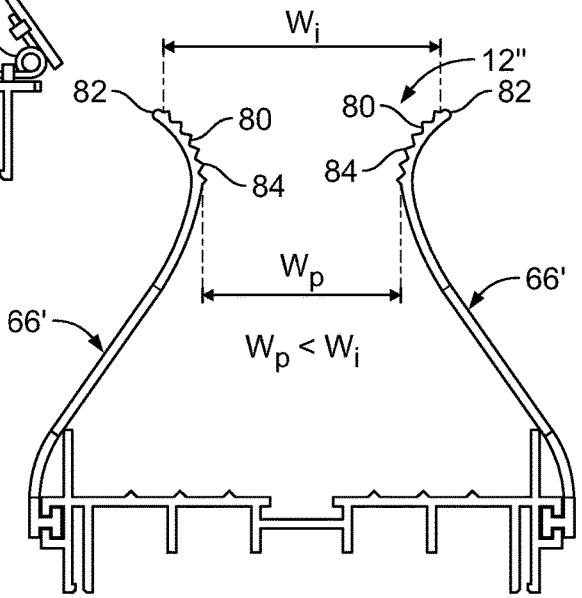
FIG. 20C is a front elevation view of yet another channel subassembly.
Figure 21:
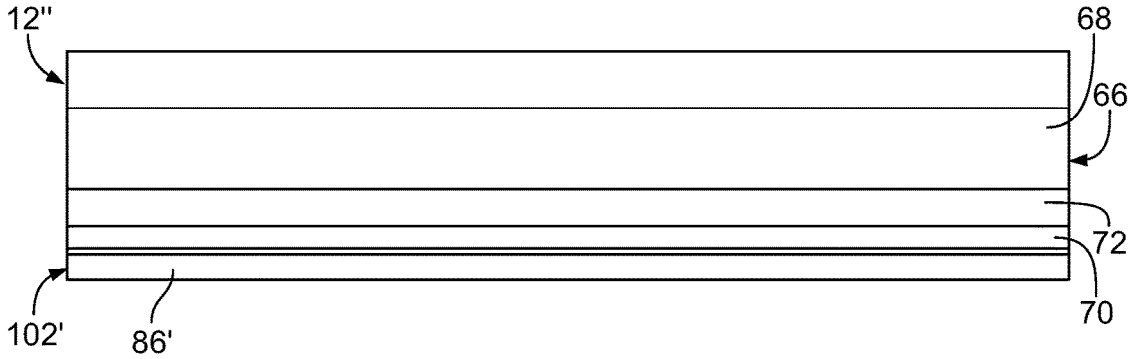
FIG. 21 is a side elevation view of the channel subassembly shown in FIG. 19B.

Shown in FIG. 20B is another alternative tray 12''', in which a separate torsion spring 103 is connected between each of a pair of fences 105 and a lower support 107. In this embodiment, the entire fence 105 may be uniformly composed of a suitable rigid material. As shown, no preload stop feature is included in tray 12''', though a preload stop rib analogous to rib 78 of tray 12" may optionally be included and function analogously to rib 78. Torsion spring 103 is a type of side support biasing component.

Figure 25:
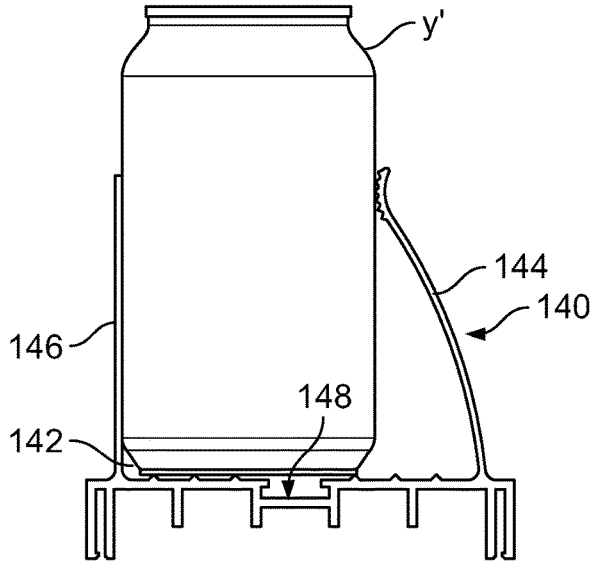
FIG. 25 is a front elevation view of another channel subassembly illustrated with a displayed item in a queue.

Shown in FIG. 25 is a feed channel member 140 similar to channel member 106 for a tray (not illustrated) containing an item Y' in a queue of like items (not illustrated) in item feed channel 142. Channel member 140 has a deflectable side fence 144 and a fixed fence 146 on either side of feed channel 142. In operation, deflectable fence 144 pushes item Y' against fixed (i.e., substantially non-deflecting) fence 146. As shown here, container Y' is not centered over T-shaped channel 148 which is not ideal for auto-advancement when an item Y' is removed from the front of the queue.

Figure 26:
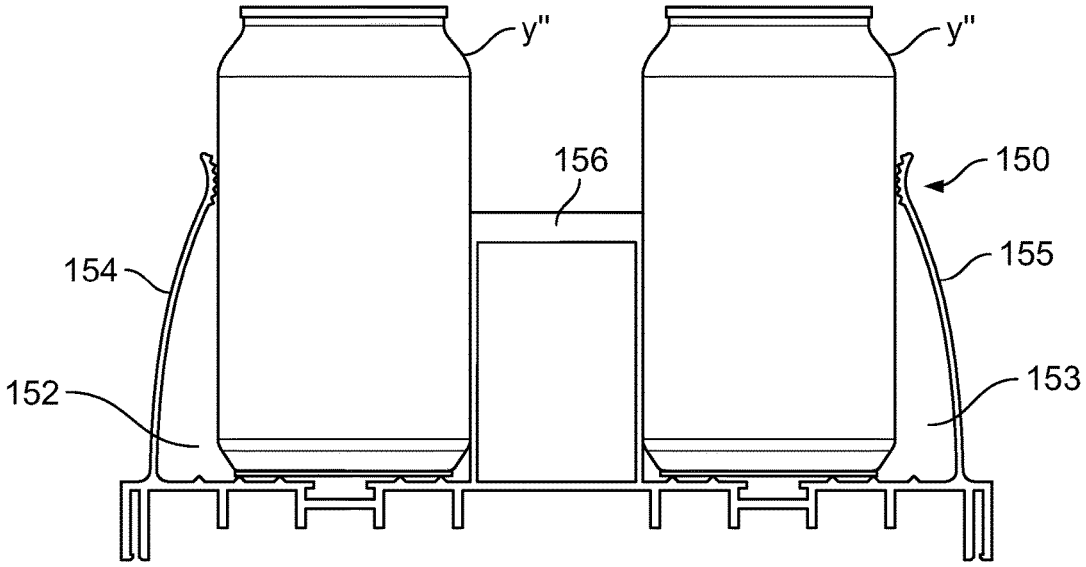
FIG. 26 is a front elevation view of another channel subassembly illustrated with two displayed items from two queues.

Shown in FIG. 26 is a feed channel member 150 similar to channel member 140 for a tray (not illustrated) containing items Y" in two queues of like items (not illustrated) in item feed channels 152 and 153. Channel member 150 has a deflectable side fence 154 and a fixed fence 156 on either side of feed channel 152. Channel member 150 also has a deflectable side fence 155 opposite to fixed fence 156 across feed channel 153. Conceivably, fixed fence 156 may be removable to accommodate a greater range of width clearances. In some cases, fence 156 may be replaced with a narrower fence. Conceivably, fence 156 may not be replaced such that feed channels 152 and 153 combine into a single channel for two item queues. Preferably, fixed fence 156 is sufficiently wide that it provides clearance between the two queues allowing a consumer's fingers to easily grip the top of item Y" when removing it from the tray. Conceivably, fixed fence 156 could be replaced with two separate fixed fences, one for each of item feed channels 152 and 153. Additionally, the two separate fixed fences could be located on opposite sides of feed channel member 150 and deflectable fences 154 and 155 could be located centrally between the two item queues.

Figure 27:
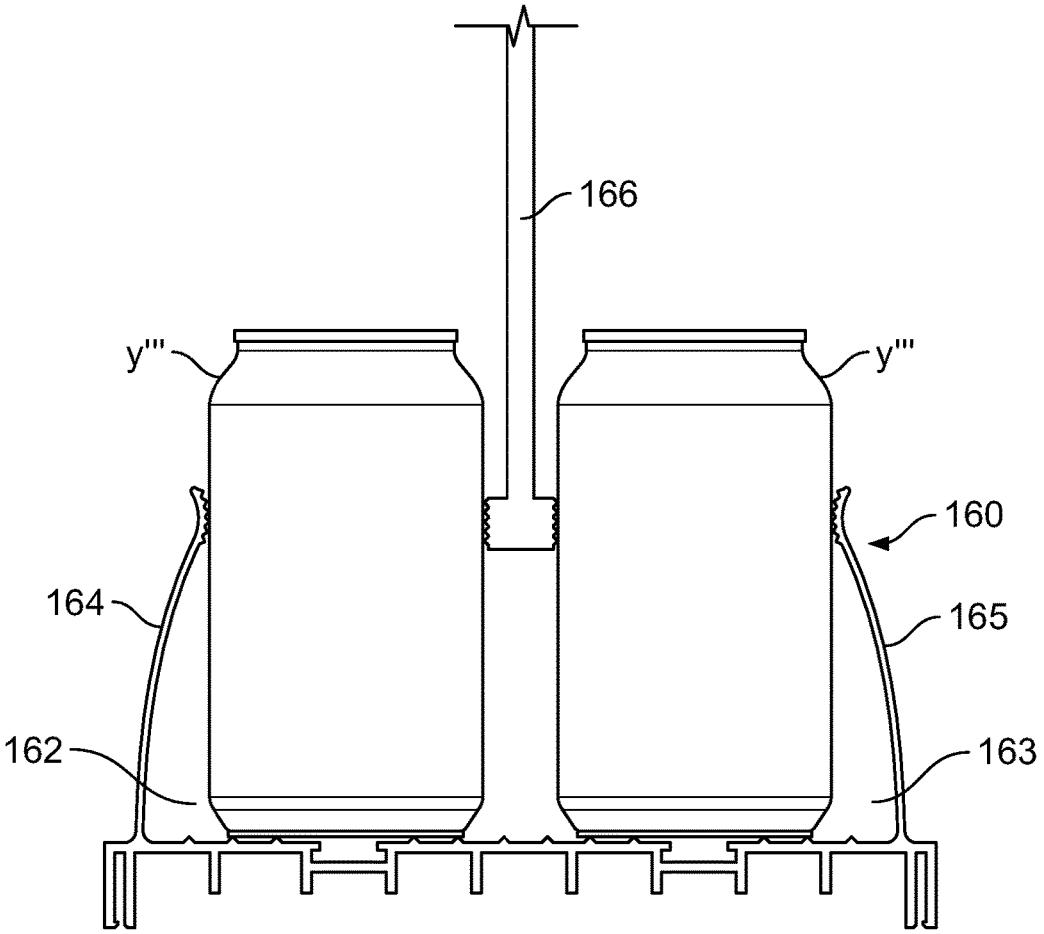
FIG. 27 is a front elevation view of another channel subassembly illustrated with two displayed items from two queues separated by a fence not connected to the channel subassembly.

Shown in FIG. 27 is a feed channel member 160 similar to channel member 150 for a tray (not illustrated) containing items Y'" in two queues of like items (not illustrated) in item feed channels 162 and 163. Channel member 160 has two deflectable side fences 164 and 165. The principal difference between feed channel members 150 and 160 is that feed channel member 160 does not have a fixed fence. Instead, there is a fixed fence 166, which may be part of the tray (not illustrated), part of the display (not illustrated) or some other structure.

While the invention has been described with respect to certain embodiments, as will be appreciated by those skilled in the art, it is to be understood that the invention is capable of numerous changes, modifications and rearrangements, and such changes, modifications and rearrangements are intended to be covered by the following claims. In particular, the inventive trays may be adapted to be mounted to any number of displays including, without limitation, a slat wall, a gondola having a central support wall having a grid of circular or elongate holes, a stand having a vertical wire grid, a 1-way display device, a 2-way display device, a 3-way display device, a 4-way display device, a 4-way pinwheel display device, a case stacker display device, a cooler topper display device, a counter display device, a cross merchandiser display device, a dump bin display device, an endcap display device, a floor display device, a lane blocker display device, a power wing display device, a shelf extender display device and a wall display device to form a display system within the scope of the invention.

What is claimed is:

1. An item dispensing tray for items of like dimensions comprising:

a generally horizontal, elongate lower support for supporting a queue of items, the support having first and second sides, a rear end, and a front end displaced horizontally from the rear end in a horizontal forward feed direction;

an item stop disposed near the front end of the lower support, the item stop being configured to obstruct movement of a front item of the queue of items in the horizontal forward feed direction, when the front item is supported on the lower support at a dispensing position proximate to the front end of the lower support;

an elongate first side support, the first side support extending along and above the first side of the lower support;

an elongate second side support spaced laterally from the first side support, the second side support extending along and above the lower support;

the lower support and the first and second side supports together defining an item queue feed channel extending longitudinally in a direction from the rear end of the lower support to the front end of the lower support, the item queue feed channel configured to retain the queue of items supported on the lower support between the first and second side supports, a respective contact section of each of the first and second side supports configured to contact a respective first and second side of items in the queue of items;

at least one of the side supports being a deflectable side support, the contact section of the deflectable side support being movable towards or away from the contact section of the other side support;

a side support biasing component configured to bias the contact section of the at least one deflectable side support relative to the lower support in a clamping direction generally toward the contact section of the other side support, the contact sections configured to transmit a clamping force to the respective first and second sides of each item of the queue of items to resist lateral transverse movement of a queue of items supported on the lower support between the first and second side supports.

2. The tray of claim 1, further comprising an item advancing member configured to transmit an advancing force to the queue of items in the horizontal forward feed direction.

3. The tray of claim 1, further comprising at least one alternate side support, at least one of the first and second side supports and the alternate side support comprising a connecting feature configured to mate with a complementary connecting feature of the lower support to permit manual removal of the at least one of the first and second side supports and manual connection of the alternate side support to the lower support.

4. The tray of claim 1 wherein both the first side support and the second side support are deflectable side supports.

5. The tray of claim 1 wherein the deflectable side support is a unitary side support member comprising the movable contact section and the biasing component.

6. The tray of claim 5, wherein the unitary side support member has a generally uniform transverse thickness.

7. The tray of claim 1 wherein the contact section of the at least one deflectable side support is comprised in a rigid contact member, and the biasing component is comprised in an elastically deformable biasing member connected to the contact member.

8. The tray of claim 7 wherein the rigid contact member and the elastically deformable biasing member are permanently bonded sections of an integral body, the contact member being composed of a rigid material and the biasing member being composed of an elastically deformable material different from the rigid material.

9. The tray of claim 8 wherein the rigid contact member and the elastically deformable biasing member are formed together by coextrusion.

10. The tray of claim 9 wherein the deflectable side support further comprises a rigid connecting member configured to connect the deflectable side support to the lower support, the connecting member being composed of a rigid material different from the elastically deformable material of the biasing member, and the deflectable side support being formed by coextrusion of the rigid contact member, the elastically deformable biasing member, and the connecting member.

11. The tray of claim 1 further comprising a preload stop connected to the lower support, the preload stop configured to contact and obstruct movement of a portion of the deflectable side support in the clamping direction when the movable contact section is at a minimum width clearance position, spaced from the other side support contact section by a minimum width clearance, to stop movement of the movable contact section in the clamping direction, and to maintain the side support biasing component in a preloaded state in the absence of items in the item queue feed channel, so that, when the movable contact section is displaced from the minimum width clearance position in a direction opposite the clamping direction by an item having a width clearance larger than the minimum width clearance, at least a preloaded clamping force is transmitted from the movable contact section to the item having the width clearance.

12. The tray of claim 11, the preload stop comprising the other side support contact section, the minimum width clearance being zero.

13. The tray of claim 11, wherein the at least one deflectable side support is connected at a lower end thereof to the lower support; and the preload stop comprises an elongate rib protruding upwardly from the lower support and extending longitudinally therealong, an upper end of the preload stop contacting the deflectable side support at a contact location between the lower end and the movable contact portion of the deflectable side support.

14. A dispensing display system comprising a display frame including a rear mounting wall comprising at least one mounting feature at each of a plurality of spaced apart mounting locations; and a plurality of item dispensing trays, each tray comprising (a) at least one rear mounting feature disposed at a rear side of the tray, the tray rear mounting feature configured to mate with said rear wall mounting feature at a selected one of said mounting locations to mount the tray to the rear mounting wall; (b) a generally horizontal, elongate lower support for supporting a queue of items, the support having front and rear sides, a rear end and a front end displaced horizontally from the rear end in a horizontal forward feed direction; (c) an item stop disposed near the front end of the lower support, the item stop being configured to obstruct movement of a front item of the queue of items in the horizontal forward feed direction, when the front item is supported on the lower support at a dispensing position proximate to the front end of the lower support; (d) an elongate first side support, the first side support extending along and above the first side of the lower support; (e) an elongate second side support spaced laterally from the first side support, the second side support extending along and above a second side of the lower support; (f) the lower support and the first and second side supports together defining an item queue feed channel extending longitudinally in a direction from the rear end of the lower support to the front end of the lower support, the item queue feed channel configured to retain the queue of items supported on the lower support between the first and second side supports, a respective contact section of each of the first and second side supports configured to contact a respective first and second side of items in the queue of items; (g) at least one of the side supports being a deflectable side support, the contact section of the deflectable side support being movable relative towards or away from the contact section of the other side support; and (h) a side support biasing component configured to bias the contact section of the at least one deflectable side support relative to the lower support in a clamping direction generally toward the contact section of the other side support, the contact sections configured to transmit a clamping force to the respective first and second sides of each item of the queue of items to resist lateral transverse movement of the queue of items supported on the lower support between the first and second side supports.

15. The dispensing display system of claim 14 wherein said at least one rear wall mounting feature is a hole and said at least one tray rear mounting feature is a hook configured to mate with the hole.

16. The dispensing display system of claim 14 wherein the display frame further comprises a side subframe connected to the rear mounting wall near a side edge thereof, the side subframe including a lower graphic panel slot, a front end graphic panel slot, and a rear end graphic panel slot, the lower graphic panel slot being disposed below a lowermost dispensing tray when the lowermost dispensing tray is mounted at a lowermost one of the rear mounting wall mounting locations, the front and rear end graphic panel slots being connected to the display frame proximate to front and rear ends of the display frame, and the graphic panel slots configured to receive respective lower, front, and rear edges of a side subframe graphic panel slidingly received between the front and rear slots.

17. The dispensing display system of claim 14, wherein the mounting locations on the rear mounting wall include at least one pair of mounting locations spaced apart by a vertical distance smaller than a height dimension of one of said dispensing trays.

18. A merchandise dispensing method using a dispensing tray for items of like dimensions, the tray comprising (a) a generally horizontal, elongate lower support for supporting a queue of items, the support having front and rear sides, a rear end and a front end displaced horizontally from the rear end in a horizontal forward feed direction; (b) an item stop disposed near the front end of the lower support, the item stop being configured to obstruct movement of a front item of the queue of items in the horizontal forward feed direction, when the front item is supported on the lower support at a dispensing position proximate to the front end of the lower support; (c) an elongate first side support, the first side support extending along and above the first side of the lower support; (d) an elongate second side support spaced laterally from the first side support, the second side support extending along and above a second side of the lower support; (e) the lower support and the first and second side supports together defining an item queue feed channel extending longitudinally in a direction from the rear end of the lower support to the front end of the lower support, the item queue feed channel configured to retain the queue of items supported on the lower support between the first and second side supports, a respective contact section of each of the first and second side supports configured to contact a respective first and second side of items in the queue of items; (f) at least one of the side supports being a deflectable side support, the contact section of the deflectable side support being movable towards or away from the contact section of the other side support; and (g) a side support biasing component configured to bias the contact section of the at least one deflectable side support relative to the lower support in a clamping direction generally toward the contact section of the other side support, the contact sections configured to transmit a clamping force to the respective first and second sides of each item of the queue of items to resist lateral transverse movement of the queue of items supported on the lower support between the first and second side supports; the method comprising moving the movable contact section of the deflectable side support to an item width clearance distance from the contact section of the other side support greater than or equal to a width dimension of a plurality of merchandise items of like dimensions;

placing the plurality of merchandise items in the item queue feed channel to form a single-file queue of the items extending from the dispensing position towards the rear end of the tray; and clamping the queue of items between the first and second side supports.

19. The method of claim 18, wherein each of the side supports comprises an upper insertion region that tapers transversely away from the opposite side support, thus defining an item insertion width clearance that is wider than a minimum item width clearance between the side support contact sections when no item is disposed in the item queue feed channel, the plurality of merchandise items having a width dimension larger than the minimum item width clearance and smaller than the item insertion width clearance between the upper insertion regions of the side supports, the method further comprising inserting one of the plurality of merchandise items between the upper insertion regions of the side supports; and pressing the inserted item downward to force the side support contact sections apart to an item width clearance equal to the item width dimension.

20. The method of claim 18 wherein respective upper ends of the side support members are spaced apart by an insertion width clearance that is larger than a bottom width dimension of the plurality of merchandise items and smaller than a retained width dimension of the plurality of merchandise items, the method further comprising inserting a bottom end of one of the plurality of merchandise items between the upper ends of the side support members; and pressing the inserted item downward to force the upper ends of the side support members apart to an item width clearance equal to the retained item width dimension.

* * * * *